US011457708B2

(12) United States Patent
Gagnon

(10) Patent No.: US 11,457,708 B2
(45) Date of Patent: Oct. 4, 2022

(54) CONTACT LENS CASE

(71) Applicant: Lorelei Vivienne Gagnon, Chicago, IL (US)

(72) Inventor: Lorelei Vivienne Gagnon, Chicago, IL (US)

(73) Assignee: Lorelei Vivienne Gagnon, Chicago, IL (US)

( * ) Notice: Subject to any disclaimer, the term of this patent is extended or adjusted under 35 U.S.C. 154(b) by 301 days.

(21) Appl. No.: 15/896,874

(22) Filed: Feb. 14, 2018

(65) Prior Publication Data

US 2019/0059543 A1 Feb. 28, 2019

Related U.S. Application Data

(60) Provisional application No. 62/552,060, filed on Aug. 30, 2017.

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 2011/006; A61L 12/086
USPC ..... 206/6.1, 5.1
See application file for complete search history.

(56) References Cited

U.S. PATENT DOCUMENTS 3,741,377 A * 6/1973 Krellen ..... A45C 11/005 206/5
4,858,754 A * 8/1989 Wright ..... A45C 11/005 206/5.1
4,942,959 A * 7/1990 Sauber ..... A45C 11/005 134/137
6,170,664 B1 * 1/2001 Dar ..... A45C 11/005 206/5.1
9,848,680 B2 * 12/2017 Lynch ..... A45C 11/005
2005/0133382 A1 * 6/2005 Gerard ..... A45C 11/005 206/5.1
2016/0198825 A1 * 7/2016 Fawdington ..... A61F 9/0061 206/5.1
2016/0316873 A1 * 11/2016 Lynch ..... A45C 11/005

OTHER PUBLICATIONS

Color Case, Contact Lens Cases, date unknown but before Jan. 1, 2018.
Beyond Optics, The Original Flip Top Contact Lens Case, date unknown but before Jan. 1, 2018.
Apex, The Apex Lens-Mate Contact Lens Case, date unknown but before Jan. 1, 2018.
Apex, https://www.amazon.com/Apex-Lens-Mate-Pack-3/dp/B000XPV3B2/ref=sr_1_cc_1_a_it?s=aps&ie=UTF8&qid=1519760782&sr=1-1-catcorr&keywords=apex+lens+mate, The Apex Lens-Mate Contact Lens Case, date unknown but before Mar. 1, 2018.
(Continued)

*Primary Examiner* — J. Gregory Pickett
*Assistant Examiner* — Jenine Pagan
(74) *Attorney, Agent, or Firm* — Duane Morris LLP

(57) ABSTRACT

A contact lens case can include a lid and a base. The base can include a foundation and a well. The well can include a radially domed lip forming an oval-shaped ring when viewed from a top plan perspective. The well can define a contact lens-solution pool. The well can include a steep outer surface from which a collar radially projects.

20 Claims, 26 Drawing Sheets

(56) References Cited

OTHER PUBLICATIONS

Amcon Labs, https://www.amazon.com/12-Pack-Flip-top-Contact-Assorted-Colors/dp/B016POMOXU/ref=sr_1_7_a_it?ie=UTF8&qid=1519946047&sr=8-7&keywords=contact+lens+case, 12-Pack, Deep Well Flip-top Contact Lens Cases Assorted Colors, date unknown but before Mar. 1, 2018.

Amcon Labs, https://www.amazon.com/dp/B06XGRGVHT/ref=psdc_4044171_t1_B00NPMIK66, 12-Pack, Deep Well Flip-top White Contact Lens Cases, date unknown but before Mar. 1, 2018.

Premium Life, https://www.amazon.com/Lens-Mate-Contact-Lense-Case-Pack/dp/B000LRA8CM/ref=sr_1_18_s_it?s=hpc&ie=UTF8&qid=1519946361&sr=1-18&keywords=contact+lens+case, Lens-Mate Contact Lens Case -2 Pack, date unknown but before Mar. 1, 2018.

Amcon Labs, https://www.amazon.com/12-Pack-Flip-top-White-Contact-Cases/dp/B06XGRGVHT/ref=sr_1_29_s_it?s=hpc&ie=UTF8&qid=1519946413&sr=1-29&keywords=contact+lens+case, 12-Pack, Deep Well Flip-top White Contact Lens Cases, date unknown but before Mar. 1, 2018.

* cited by examiner

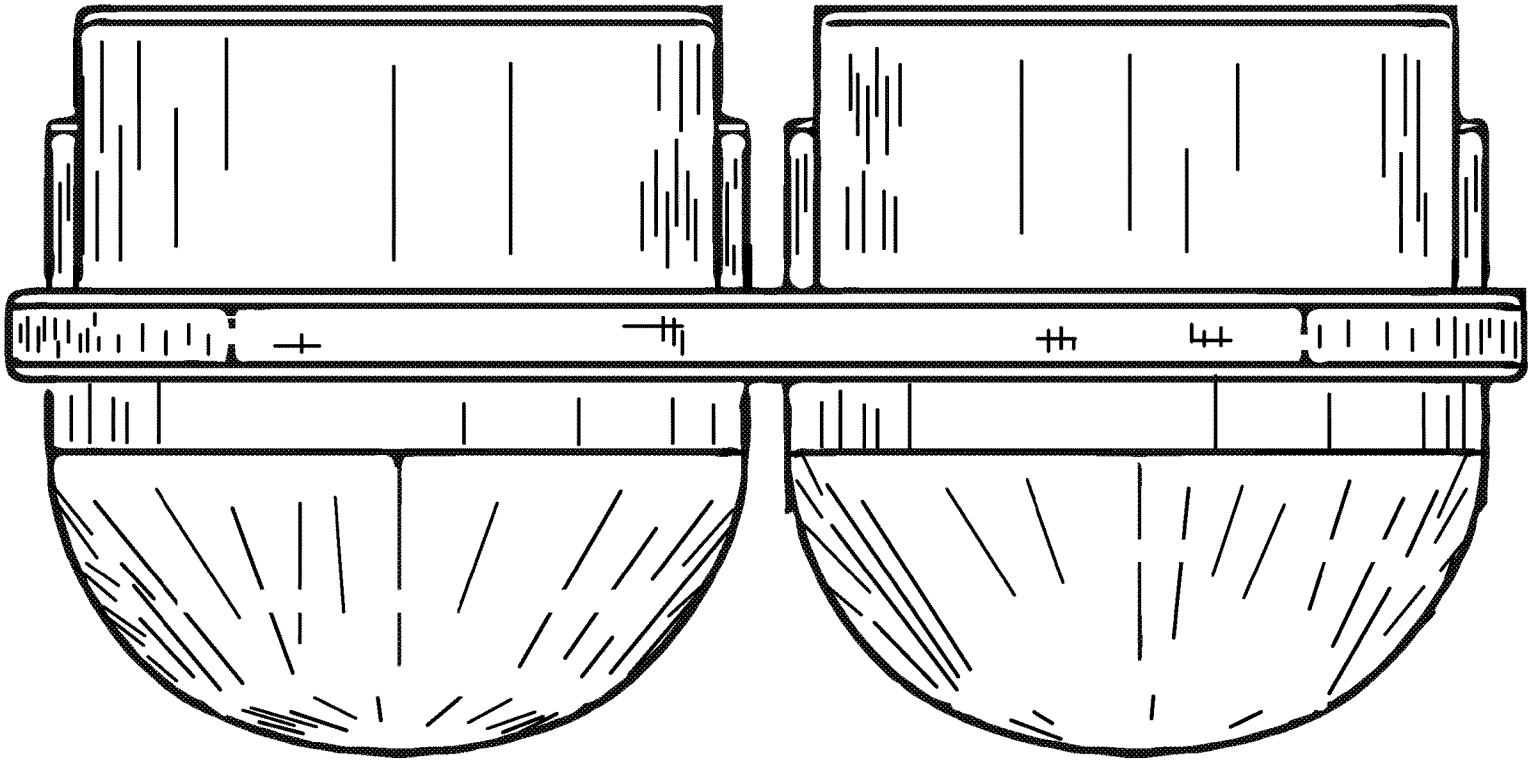
FIG. 6
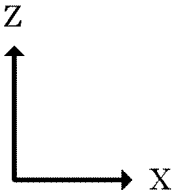

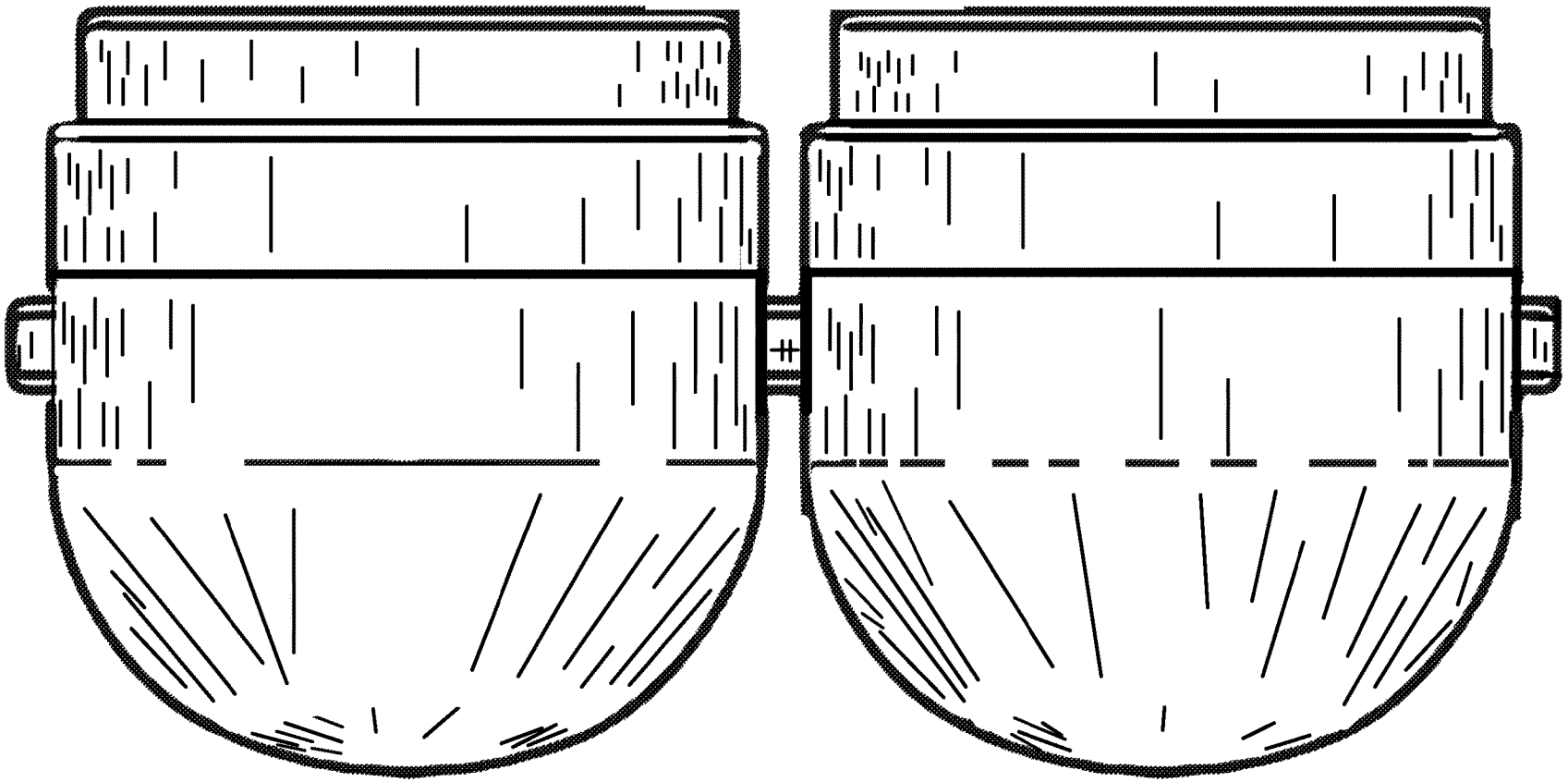
FIG. 7
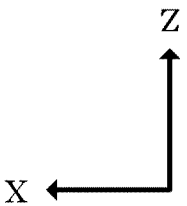

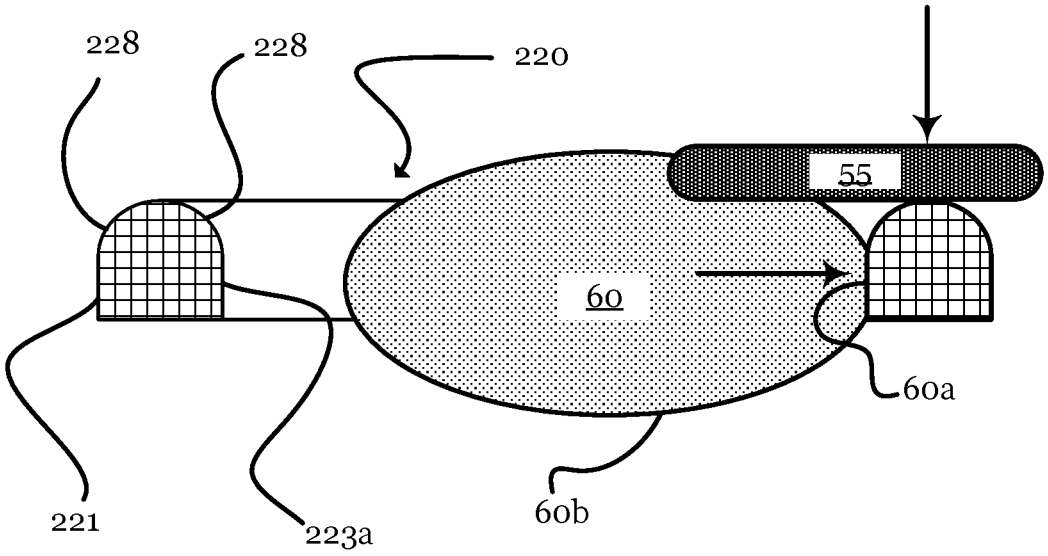
FIG. 12
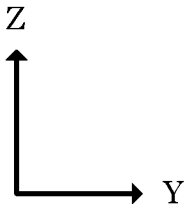

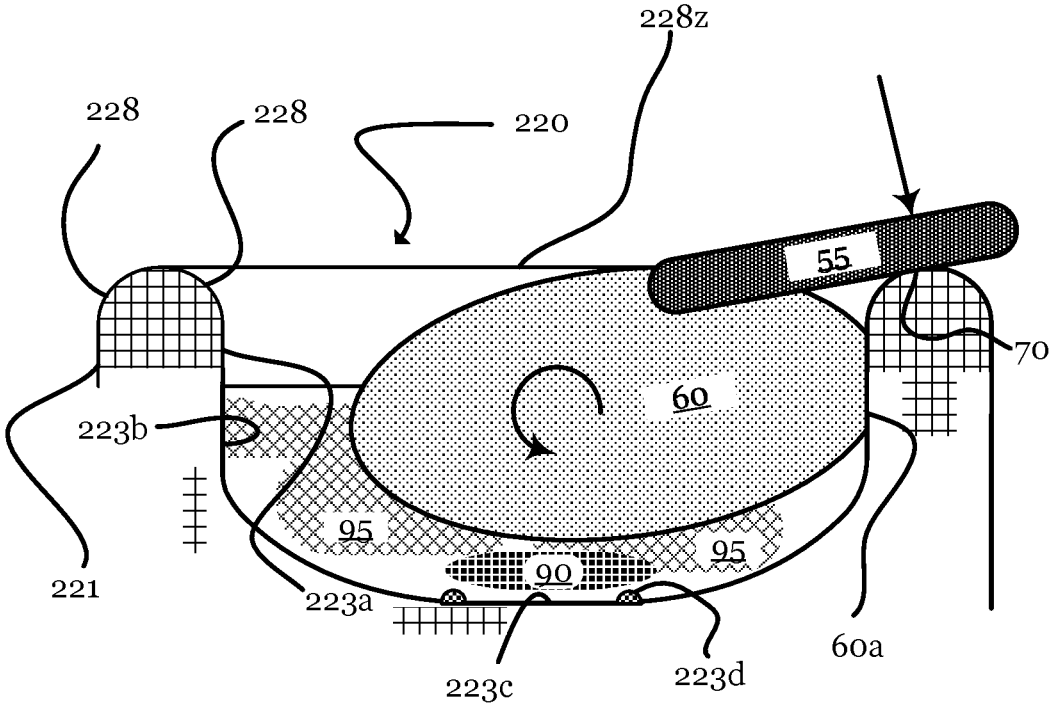
FIG. 13
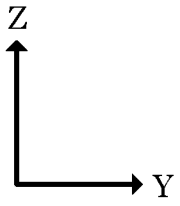

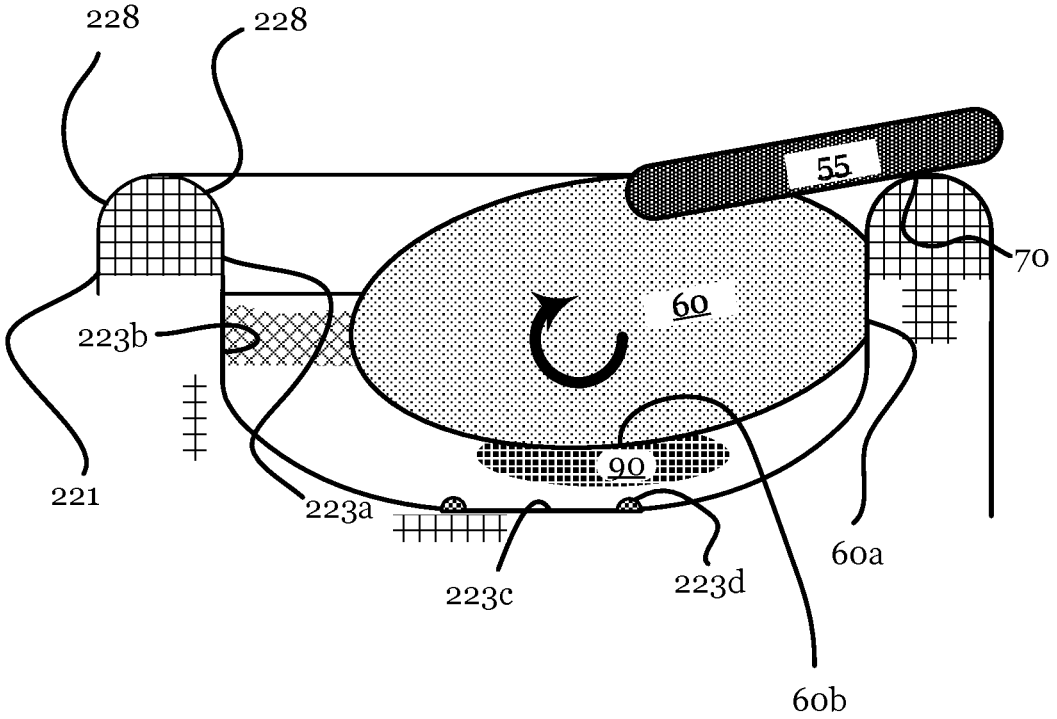
FIG. 14
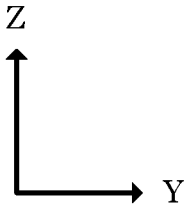

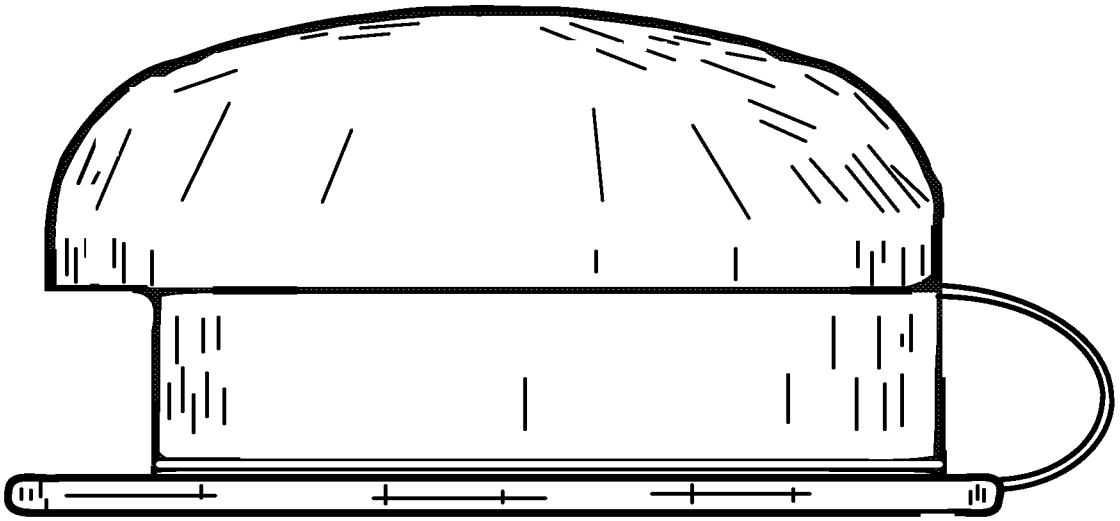
FIG. 24
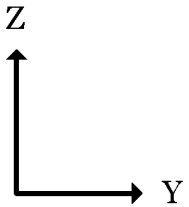

CONTACT LENS CASE

CROSS-REFERENCE

The present application claims the benefit of U.S. Provisional App. No. 62/552,060 to L. V. Gagnon (filed on 30 Aug. 2017), which is hereby incorporated by reference. U.S. Design application Ser. No. 29/637,176 to L. V. Gagnon (filed on 14 Feb. 2018) is hereby incorporated by reference.

DESCRIPTION OF RELATED ART

Before sleep, many contact lens wearers deposit their lenses in a case. The wearers can immerse the lenses in a sterile contact lens solution, which cleans the lenses overnight. Contact lenses are moisture sensitive. Dry contact lenses can disintegrate. Contact lens solution tends to evaporate when exposed to ambient air. As a result, contact lens cases often include sealing features to discourage evaporation.

SUMMARY

A contact lens case can include a lid and a base. The base can include a foundation and a well. The well can include a radially domed lip forming an oval-shaped ring when viewed from a top plan perspective. The well can define a contact lens-solution pool. The well can include a steep outer surface from which a collar radially projects.

Among other things, embodiments of present disclosure offer a visually appealing contact lens case design that enables users to extract a contact lens from contact lens solution with ease. The users can have long fingernails. The long fingernails can be natural or artificial fingernail extensions adhered to a natural fingernail. Embodiments of the present disclosure enable users with thicker fingers and/or motion impairments (e.g., arthritis) to extract a contact lens from solution in a more efficient and/or less painful manner. Embodiments of the present disclosure provide a contact lens case configured to form a tight seal about a contact lens immersed in solution. Additional features and advantages are described herein, and will be apparent from, the following Detailed Description and the Figures.

BRIEF DESCRIPTION OF THE DRAWINGS

The above summary and the below detailed description of illustrative embodiments (also called embodiments or examples) may be better understood when read in conjunction with the appended Figures. The Figures show some of the embodiments discussed herein. As further explained below, the claims are not limited to the illustrative embodiments. Any features of the illustrative embodiments can be combined. For clarity and ease of reading, some Figures may omit views of certain features. Surface shading indicates exemplary surface contour. Stippling and/or hatching indicates cross section. Broken lines indicate hidden features.

FIG. 6 is a front elevational view thereof.

FIG. 7 is a rear elevational view thereof.

FIGS. 11-14 schematically show various stages of a user extracting a solution immersed contact lens from the contact lens case. Hatched and stippled features are in cross-section.

FIG. 24 is a right elevational view of the contact lens case in a fully closed position.

DETAILED DESCRIPTION

As discussed above, the detailed description discloses illustrative embodiments. The claims are not limited to the disclosed embodiments. Therefore, some implementations consistent with the claims will have different features than in the disclosed embodiments. Changes can be made to the claims without departing from the spirit of the disclosure. The claims are intended to cover implementations with such changes.

Of the many embodiments disclosed herein, a few are drawn to scale in the Figures. According to one of these embodiments, each Figure is drawn to scale (although each Figure can observe a different scale). According to some embodiments, at least FIGS. 1, 2, 3, 4, 5, 6, and 7 are drawn to scale. According to other embodiments, none of the Figures are drawn to scale. Therefore, the relative dimensions shown in any of the Figures can be relied on, but the claims are not limited to the relative dimensions unless explicitly stated otherwise.

At times, the present application uses relative terms (e.g., front, back, top, bottom, left, right, etc.) to give the reader context when viewing the Figures. Relative terms in the description do not limit the claims. Any relative term can be replaced with a numbered term (e.g., left can be replaced with first, right can be replaced with second, and so on). When features are disclosed as being the same (and equivalents thereof), the features can be identical or substantially similar to account for manufacturing tolerances. Unless context dictates otherwise, the term substantially (and equivalents thereof) encompasses up to ±10% deviation from mean. Unless context dictates otherwise, features are generally described in their orientations when contact lens case 100 is fully closed.

Figure 1:
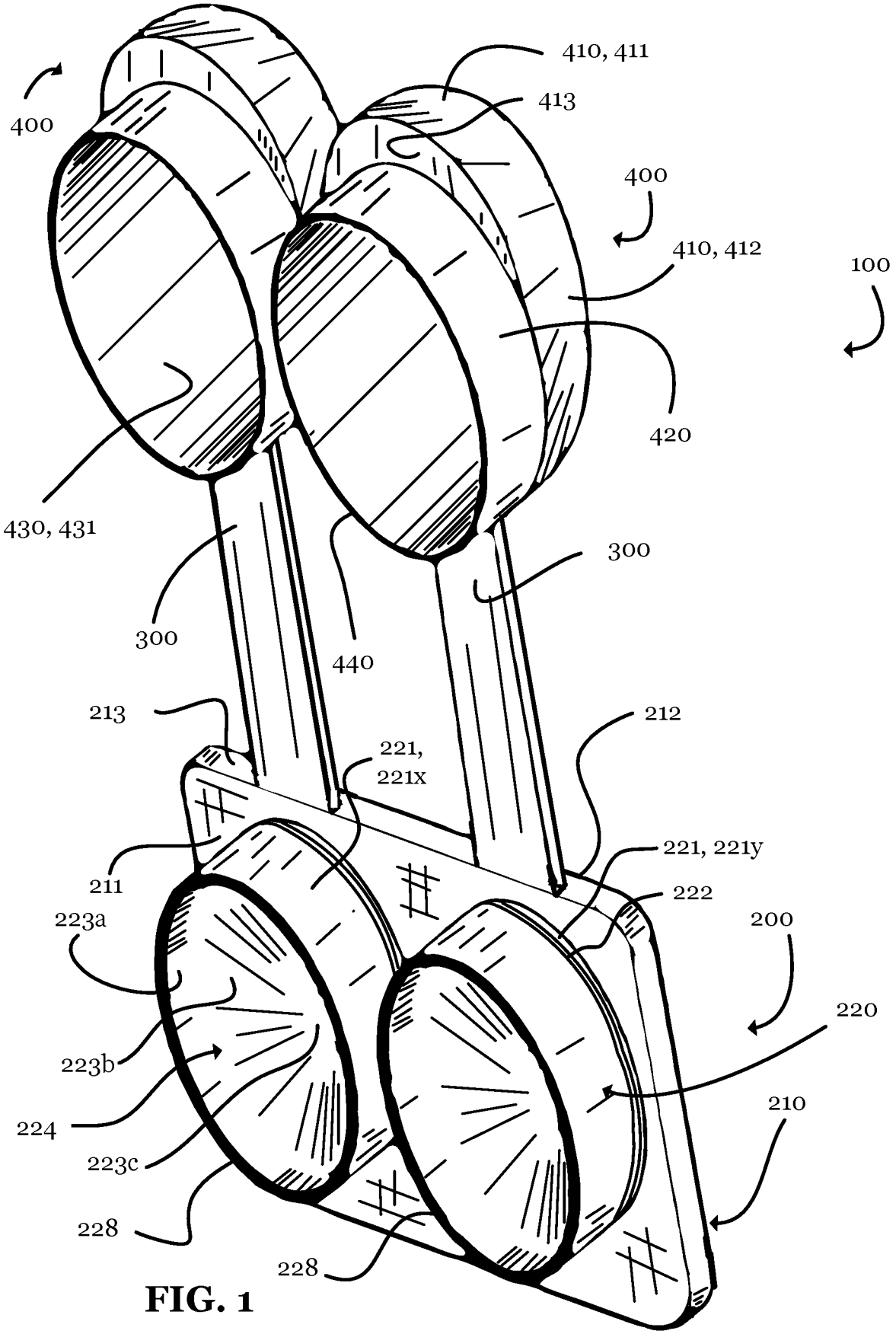
FIG. 1 is a top isometric view of a contact lens case in a stretched open position.

Referring to FIG. 1, contact lens case 100 (also called a case) can include a base 200, a pair of links 300, and a pair of lids 400. A user can deposit medical-grade contact lenses in base 200. Before or after depositing the lenses, the user can immerse the contact lenses with medical-grade and sterile contact lens solution. The user can bend links 300 to seal base 200 with lids 400. Contact lens case 100 can be integral and made from a food-grade plastic such as food-grade polypropylene.

Figure 2:
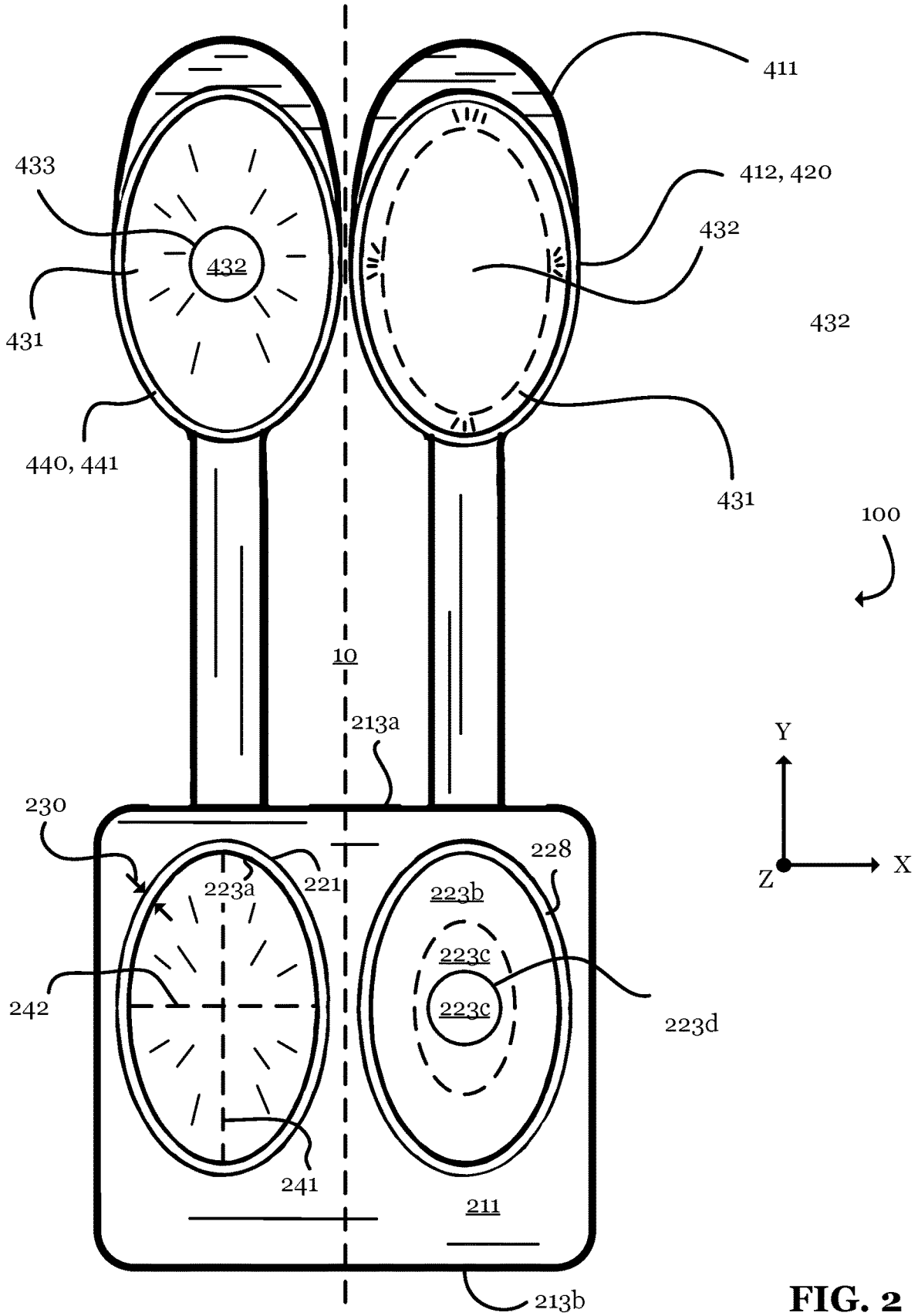
FIG. 2 is a top plan view thereof.
Figure 3:
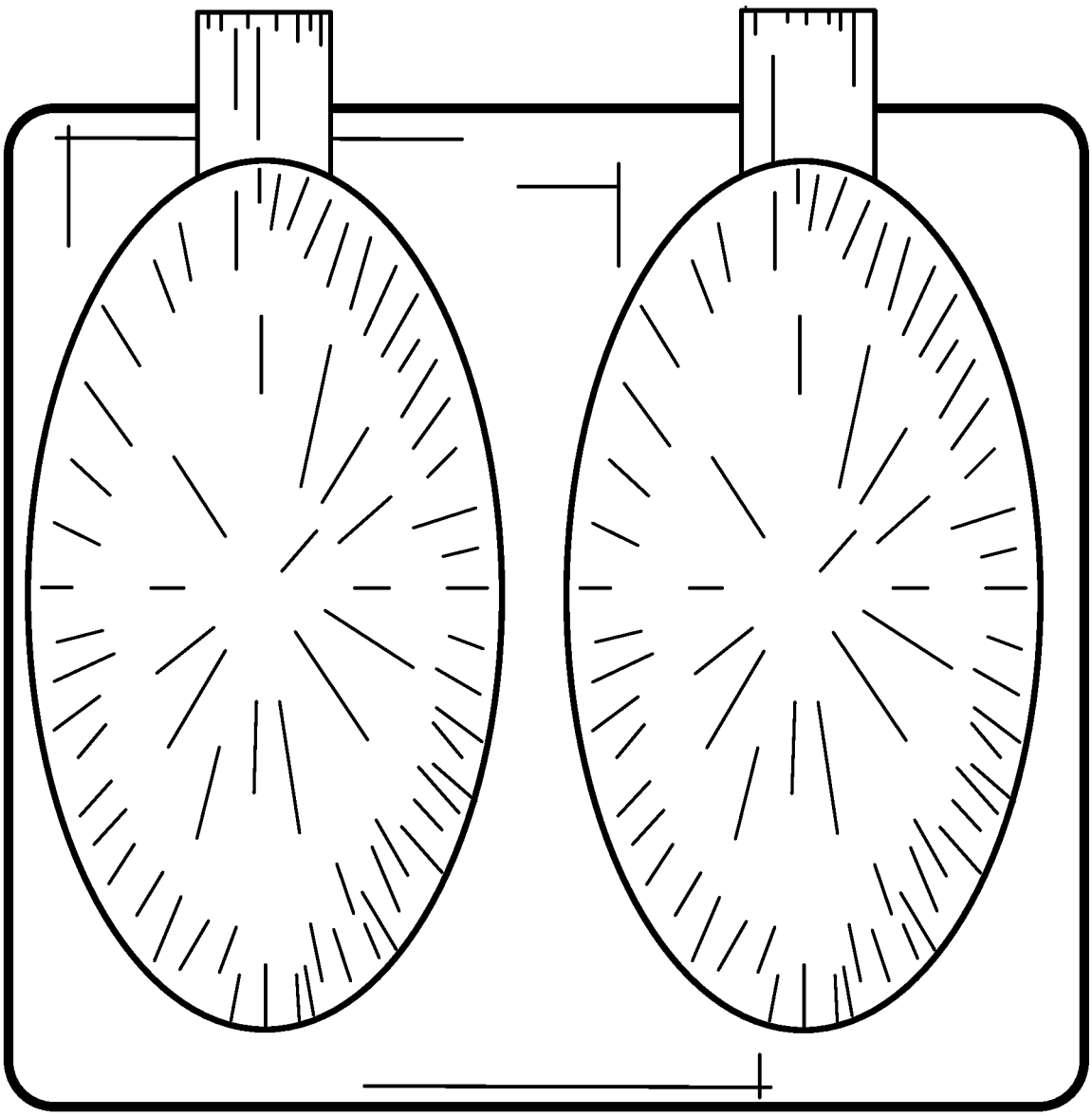
FIG. 3 is a top plan view of the contact lens case in a fully closed position.
Figure 3:
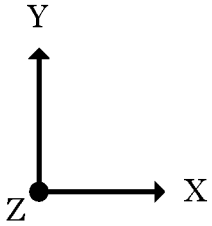

Referring to FIGS. 1 and 2, base 200 can include a foundation 210 (also called a seat or a plate) and a pair of wells 220 (also called cups or reservoirs). Foundation 210 can rest on a counter 15 (i.e., a flat ambient surface), shown in FIG. 3. Wells 220 can upwardly protrude from foundation 210. Each well 220 can hold one contact lens immersed in contact lens solution.

Some Figures (e.g., FIG. 2) use different illustration techniques for the left half and right half of case 100. The techniques are not intended to imply that the left half and right half are different. In some embodiments, case 100 is symmetrical about axis 10 (shown in FIG. 2) and thus the left half and right half of case 100 are mirror images.

Figure 5:
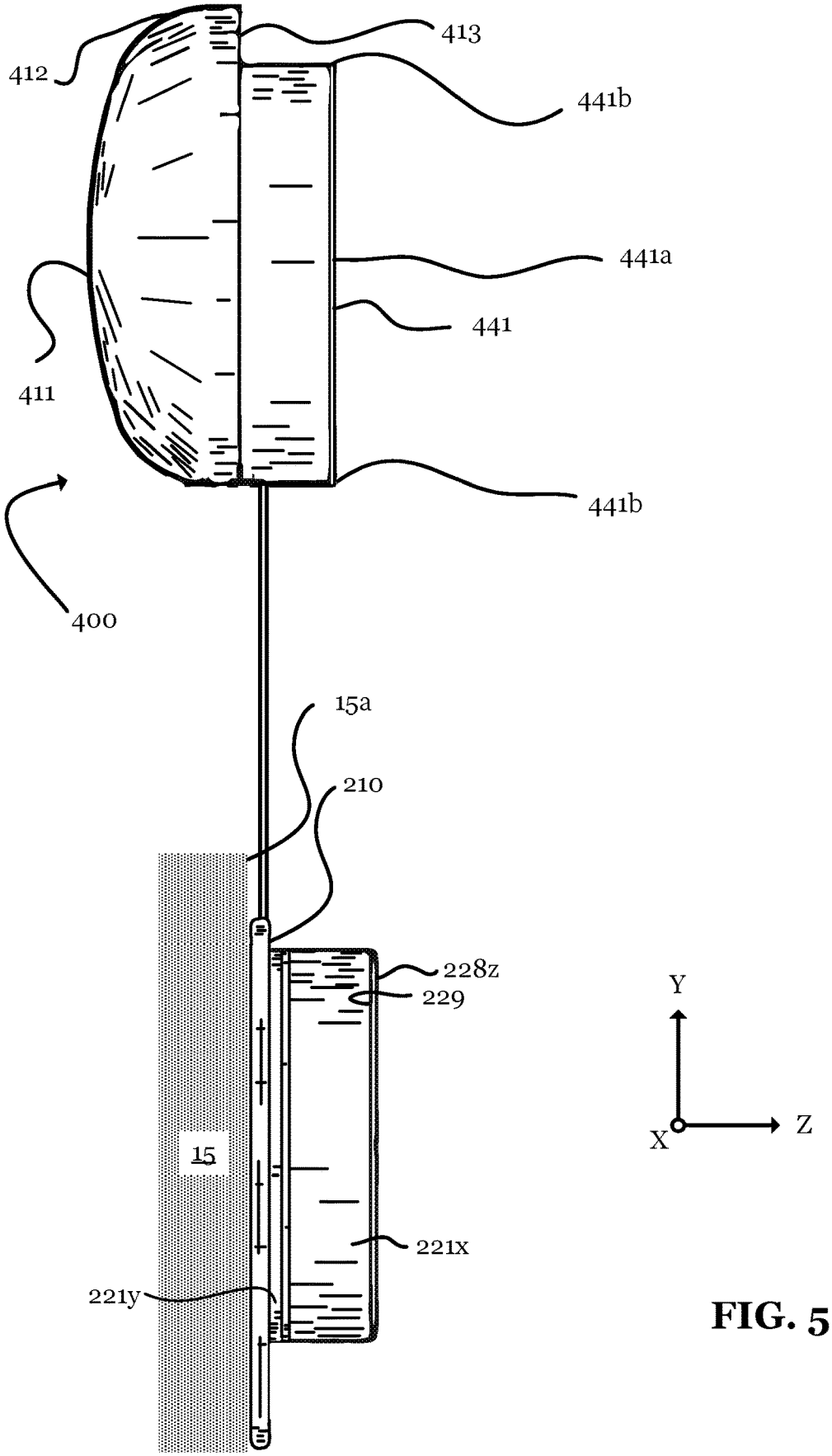
FIG. 5 is a side elevational view of the contact lens case in the stretched opened position and disposed on a counter. The counter is stippled to indicate cross-section.

FIGS. 2 and 5 show reference X, Y, and Z axes. The XY ground plane (i.e., the ground-plane) can be coplanar with countertop upper surface 15*a*, foundation bottom surface 212, and/or foundation top surface 211. The Z axis can extend normal from the ground plane. Relative orientations (e.g., top, bottom, left, right, forward, backward) appear for the reader's convenience. As used in the specification, top/bottom refer to the Z axis, left/right refer to the X axis, and forward/backward refer to the Y axis. The Z axis is called the vertical dimension. The X axis is called the horizontal dimension. The Y axis is called the longitudinal dimension. With respect to case 100, "backward" conveys positive movement along the Y axis. With respect to the user's finger (further discussed below), "forward" conveys positive movement along the Y axis.

Referring to FIGS. 1 and 2, foundation 210 can include a flat upper surface 211, a flat lower surface 212, and a peripheral surface 213. Peripheral surface 213 can have filleted corners. Links 300 can extend from peripheral surface 213. As shown in FIG. 2, wells 220 can be disposed closer to rear peripheral surface 213*a* than front peripheral surface 213*b*. Alternatively, wells 220 can be disposed closer to front peripheral surface 213*b* than rear peripheral surface 213*a* (not shown).

Figure 4:
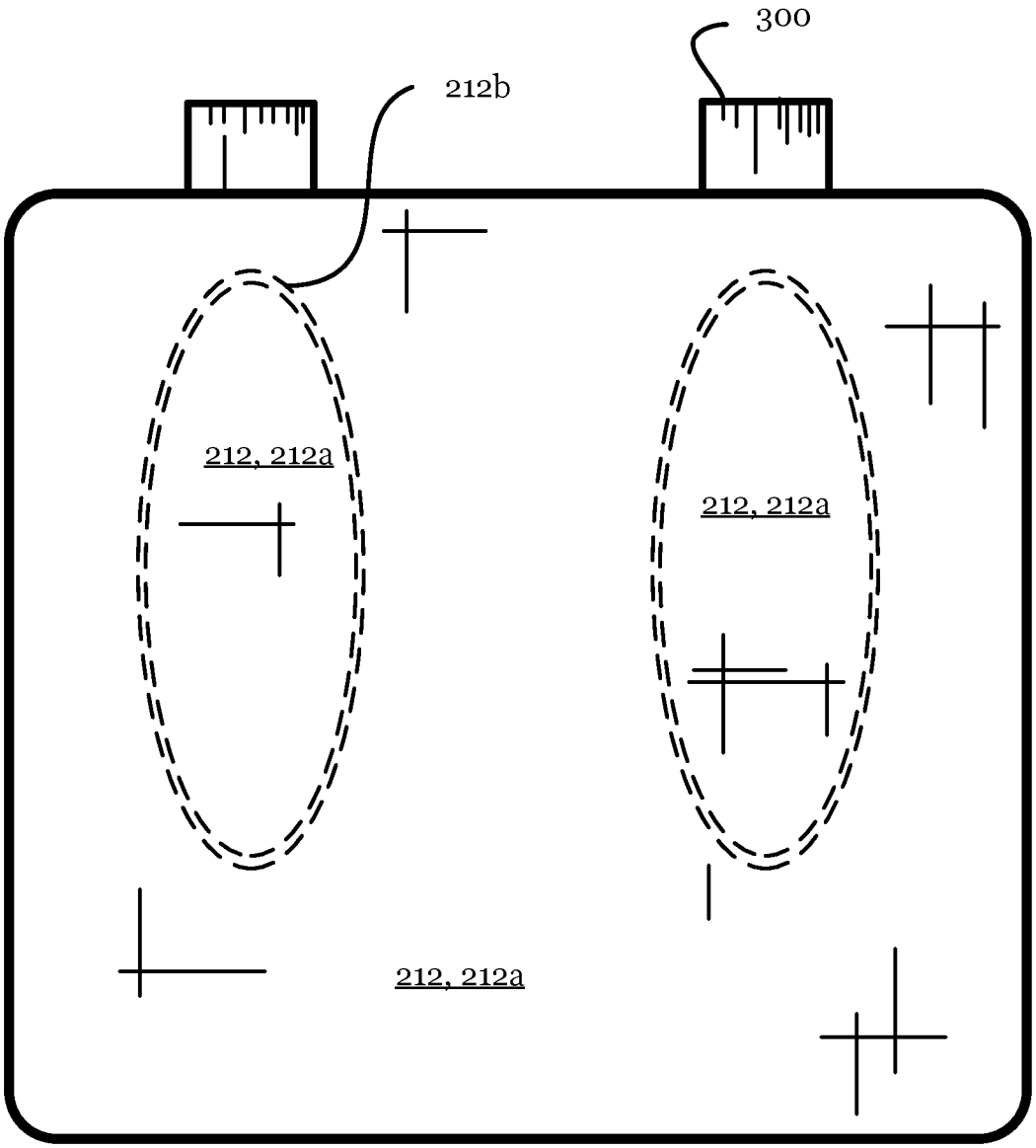
FIG. 4 is a bottom plan view thereof.

Referring to FIG. 5, foundation 210 can have a constant thickness. As shown in FIGS. 4 and 5, lower surface 212 of foundation 210 can be flush against counter 15. In some embodiments, and as shown in FIG. 4, lower surface 212 can be flat 212*a* against counter 15 except for two ring-shaped upwardly extending depressions 212*b* (i.e., grooves).

Each well 220 can include an outer sealing surface 221, a collar 222, and an inner surface 223. Outer sealing surface 221 can be flat in a vertical dimension and arced in a ground-plane dimension. Collar 222 can be a ring radially protruding from outer sealing surface 221. Collar 222 can have a constant radial thickness of less than 2, 1.5, and 1 mm. Collar 222 can partition outer sealing surface 221 into an upper portion 221*x* and a lower portion 221*y* (see FIG. 5).

Referring to FIGS. 1 and 2, inner surface 223 can be a basin or bowl defining an open pool 224 (also called a lens-solution pool). Pool 224 can hold one contact lens immersed in contact lens solution. Inner sealing surface 223 can include a steep cliff 223*a*, a transition 223*b*, and a floor 223*c*. Cliff 223*a* can be vertical such that the thickness of well 220 between cliff 223*a* and outer sealing surface 221 is constant (e.g., substantially uniform).

Transition 223*b* can arc into floor 223*c*. Floor 223*c* can be flat in the ground-plane. Floor 223*c* can be arced, but to a lesser extent than transition 223*b*. The entirety of inner surface 223 can be geometrically continuous (i.e., smooth). As shown in FIG. 2, inner surface 223 can be geometrically continuous except for a rough edge defined by the ringed artifact 223*d* and one or both of transition 223*b* and floor 223*c* (depending on the size of artifact 223*d*). The center of floor 223*c* can be the deepest region of well 220. If artifact 223*d* is present, the center of floor 223*c* can be disposed within artifact 223*d*. Floor 223*c* can have a constant depth and be the deepest region of well 220.

Figure 8:
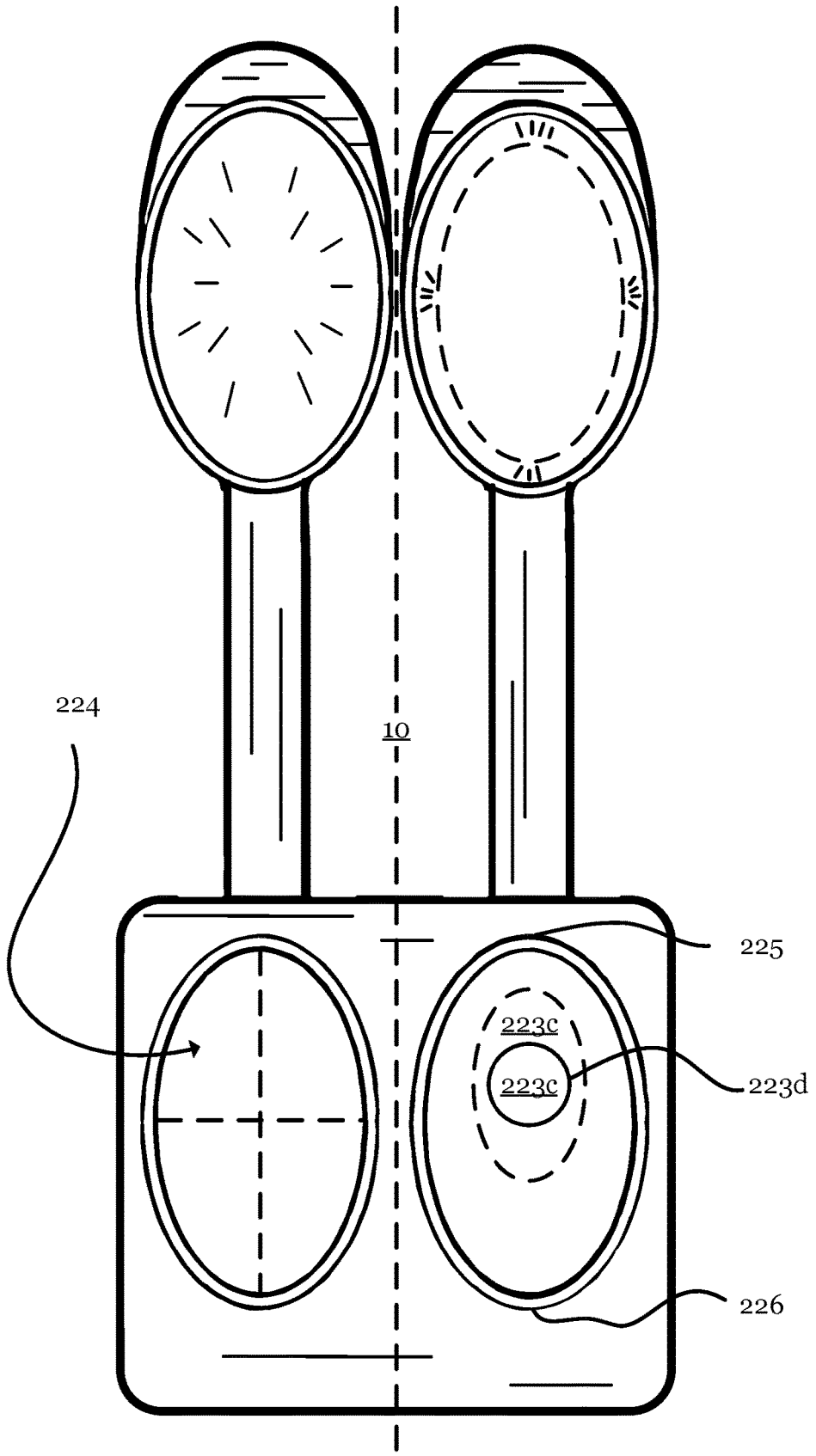
FIG. 8 is a top plan view of the contact lens case with a longitudinally well floor.
Figure 9:
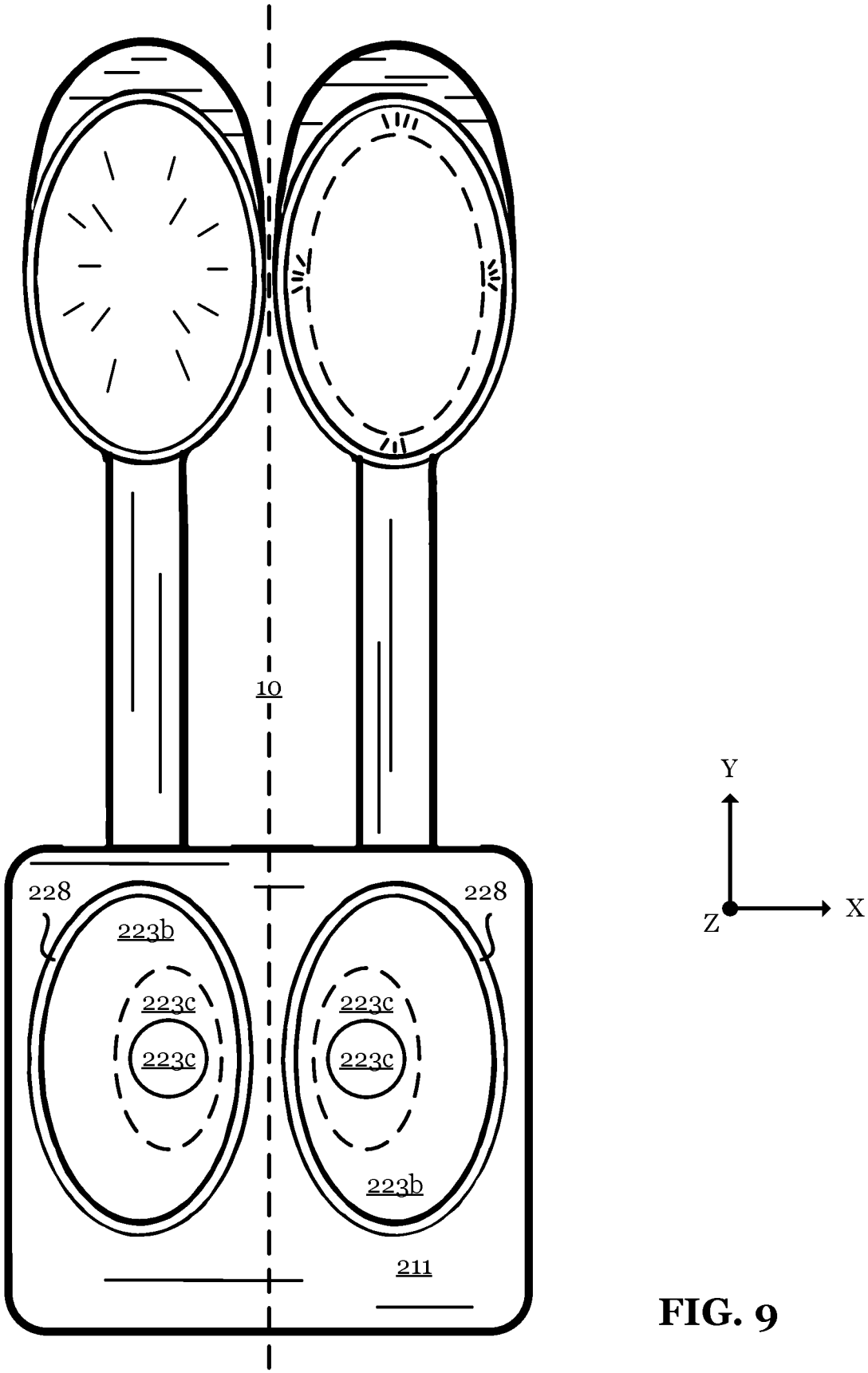
FIG. 9 is a top plan view of the contact lens case with a horizontally offset well floor.

In FIG. 2, floor 223*c* can be centrally located. Alternatively, and as shown in FIG. 8, floor 223*c*, and thus the deepest portion of pool 224, can be disposed closer to a well rear 225 than a well front 226. This embodiment can encourage gravity to draw contact lens, while immersed in fluid, toward rear 225 and away from front 226. According to another embodiment (not shown), floor 223*c* can be disposed closer to front 226 than rear 225. As shown in FIG. 9, floor 223*c* can be left-offset for right well 220 and right-offset for left well 220.

Figure 10:
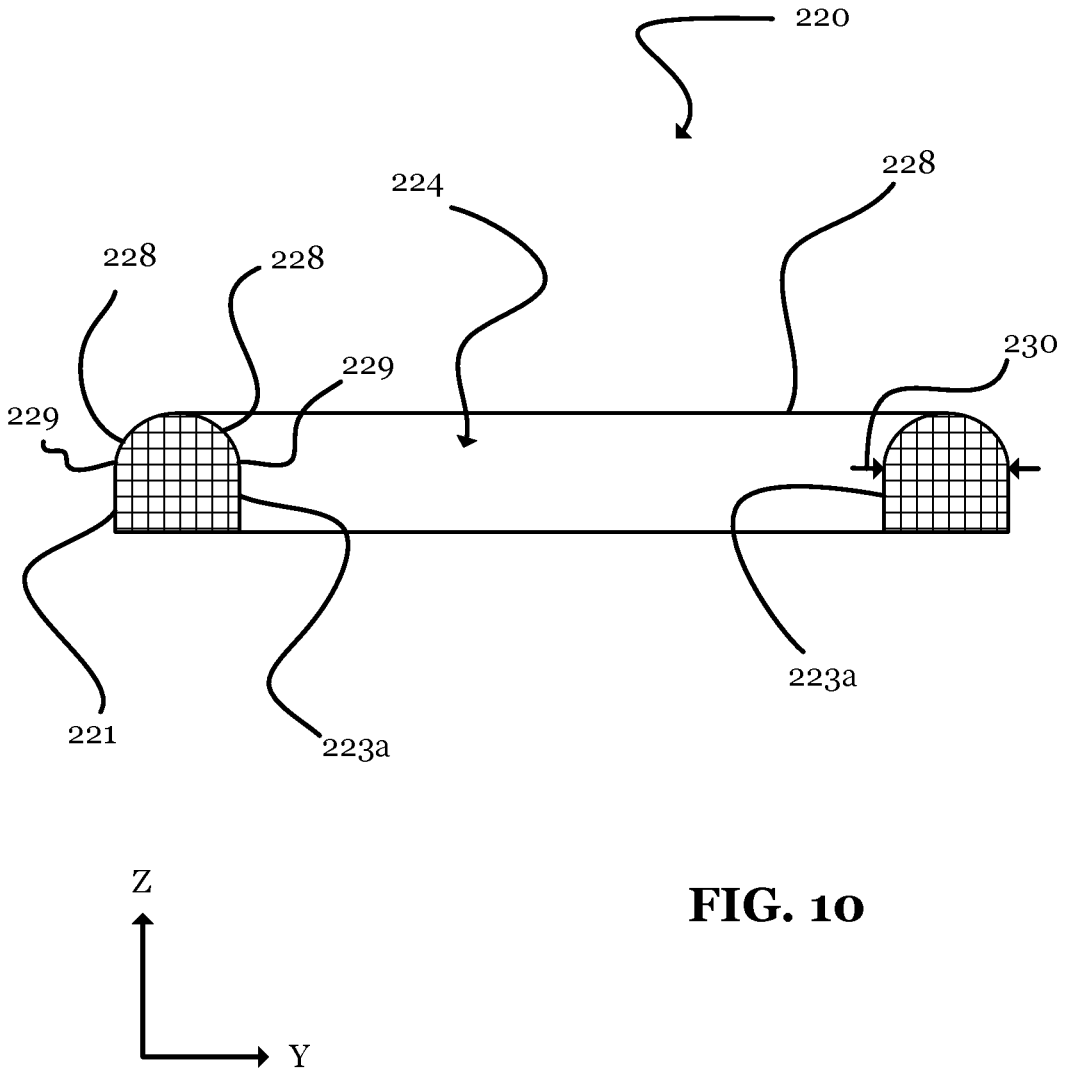
FIG. 10 is a side elevational, cross sectional, and schematic view of a well lip. Hatching indications cross-section.

Well 220 can include an upper lip 228. Lip 228 can be dome-shaped in the radial direction as shown schematically in FIG. 10. Lip 228 can lack hard edges and creases and an edge 229 can be formed between lip 228 and outer surface 221 and/or between lip 228 and cliff 223*a* (see FIG. 10). Lip 228 can have a maximum radial thickness 230 of at least 0.5, 0.6, 0.7, 0.8, 0.9, 1, 1.2, 1.5 mm. As shown in FIG. 2, the two-dimensional plan projection of inner surface 223 can be an oval with a major-axis 241:minor-axis axis 242 ratio of 1.2-2.2, 1.3-2, 1.4-1.7, 1.5-1.65, 1.58-1.64, and/or 1.6±10%. Well 220 is not limited to an oval-shape and can be, for example, rectangular, circular, and the like. Put differently, embodiments of the present disclosure offer aesthetic and functional improvements to a contact lens case with wells that are circular, rectangular, etc.

FIGS. 11-15 show stages of a user extracting contact lens 90 from well 220. The user can have a long fingernail 55. The straight unlabeled arrows show forces applied by fingerpad 60 and/or fingernail 55 against well 220. The arced unlabeled arrows show the direction of pivot (i.e., rotation). FIGS. 11-15 can represent cross sectional views through a major axis of well 220. As previously discussed, the major axis can be angled with respect to the longitudinal or parallel with the longitudinal.

Figure 11:
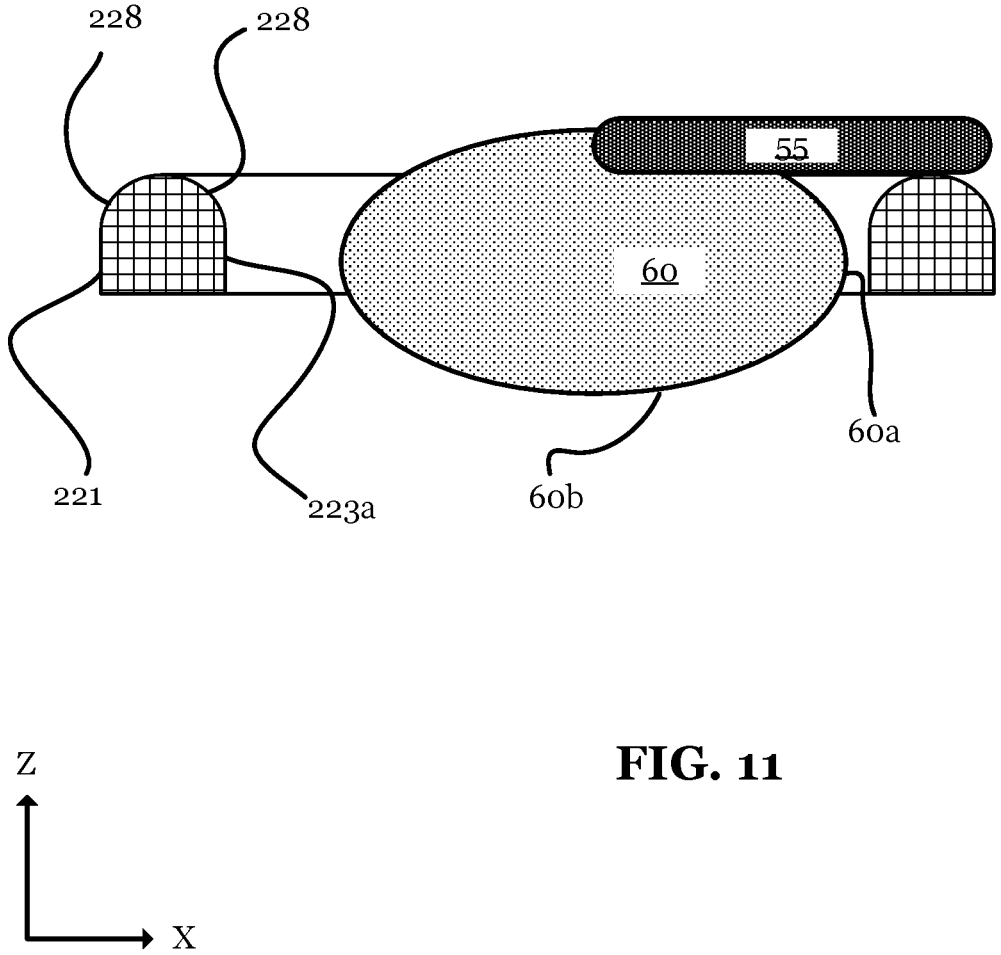

Referring to FIG. 11, the user can rest fingernail 55 on lip 228, then slide the finger toward the rear of foundation 210 (not shown) until a front surface 60*a* of a fingerpad 60 bears against (e.g., firmly presses against) well inner surface 223*a*, as shown in FIG. 12.

Referring to FIG. 13, the user can downwardly pivot fingerpad 60 about the contact 70 between fingernail 55 and lip 228 until a lower surface of fingerpad 60 engages contact lens 90 immersed in contact lens solution 95. After contact lens 233 wraps about (i.e., firmly engages or sticks to) fingerpad 60, the user upwardly pivots fingerpad 60 about the lip 228/fingernail 55 contact until fingerpad 60 is clear of well 220. FIG. 14 shows fingerpad 60 during the upward pivot.

Figure 15:
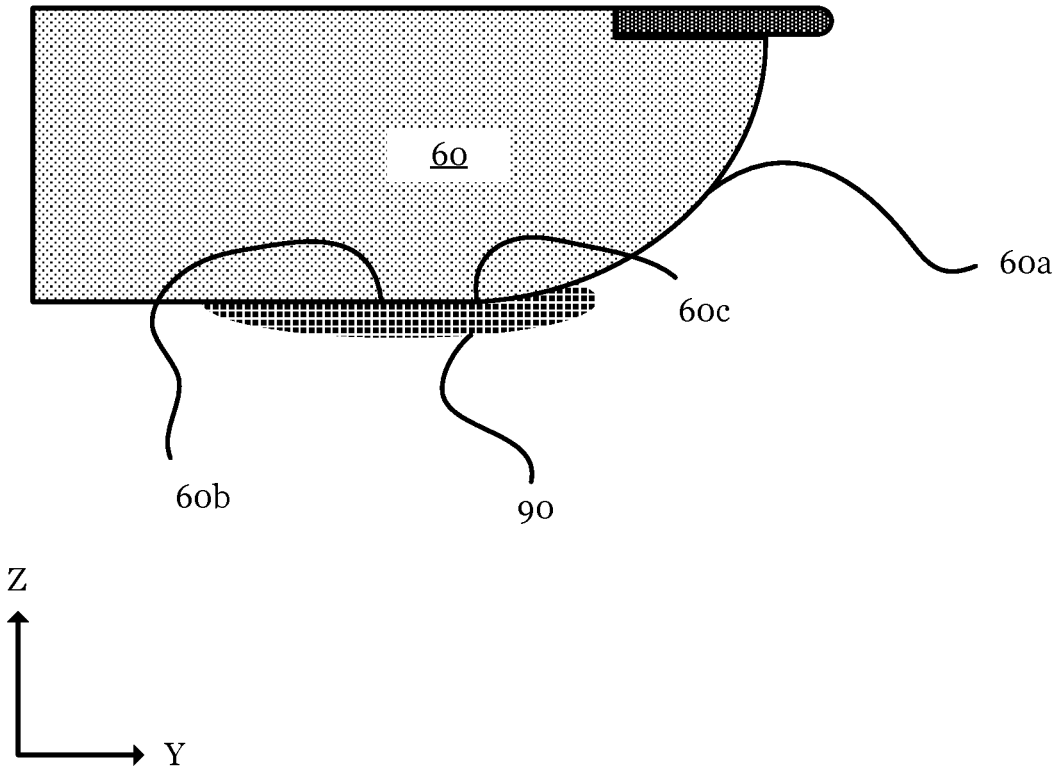
FIG. 15 shows how a contact lens can adhere to the user's finger during the extraction. Hatched and stippled features are in cross-section.
Figure 16:
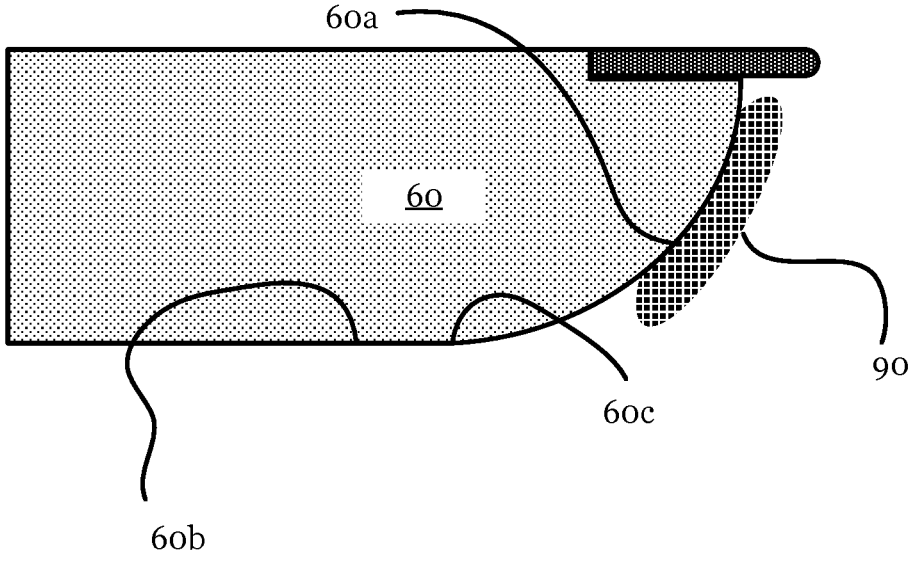
FIG. 16 PRIOR ART
FIG. 16 shows how a contact lens adheres to a user's finger during extraction from various prior art contact lens cases. Hatched and stippled features are in cross-section.

As shown in FIG. 14, contact lens is wrapped about a lower surface 60*b* of fingerpad 60. FIG. 15 gives enhanced context to lower surface 60*b*. Fingerpad 60 can include an arced front surface 60*a* and a flat (e.g., generally flat) lower surface 60*b* separated by an inflection 60*c*. According to some embodiments, contact lens 90 wraps partially about lower surface 60*b* and partially about front surface 60*a* when being removed from well 220. As shown in FIG. 15, the majority of the contact between lens 90 and fingerpad 60 (e.g., at least 60, 70, 80, 85, 90, 100%) is between lens 90 and lower surface 60*b*. These embodiments of the disclosure contrast with at least some prior art designs where 100% of the contact between lens 90 and fingerpad 60 is at front surface 60*a* (see FIG. 16). Some embodiments of case 100 can produce the effect shown in FIG. 16.

Although the a user with a long fingernail 55 is shown, case 100 can be useful in other contexts. For example, a user with a short fingernail can apply the above-described method by resting fingerpad 60 on well lip 228. The user can then bend the finger downward to engage contact lens 90 with a portion of the finger directly below the distal interphalangeal joint.

Figure 26:
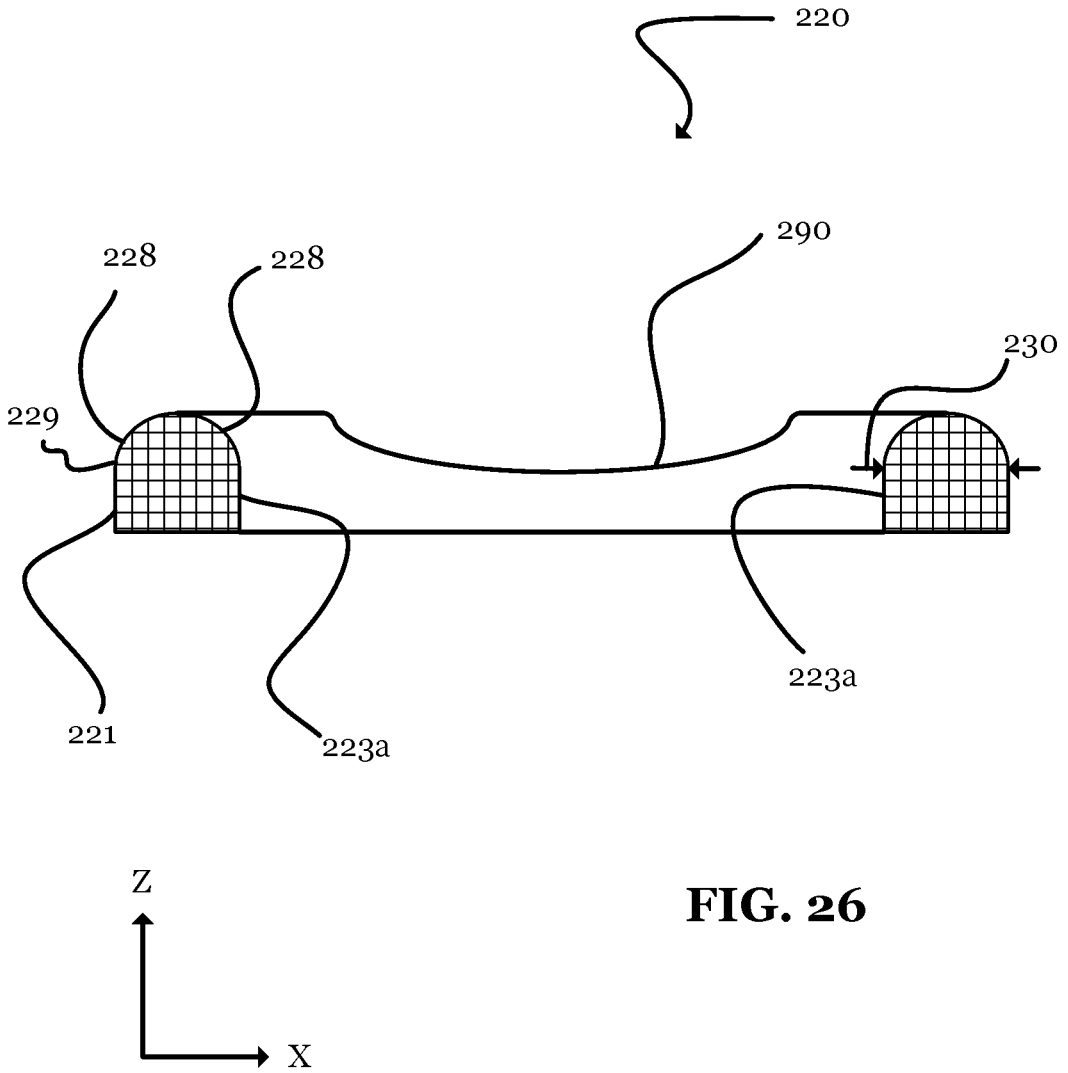
FIG. 26 is a front elevational view of a lens-solution well.

Referring to FIG. 26, lip 228 of well 220 can define a slot 290. Slot 290 can have a center collinear with the major well axis. As shown, slot 290 can be rounded or arced from an elevational perspective and include rounded (i.e., filleted) edges. Slot 290 can be for positioning. A user can slip fingerpad 60 and/or fingernail 55 into slot 290 and slide the same to a bottom of slot 290. Slot 290 can therefore help align the user's finger with the major axis of well 220 when performing the above-discussed method. Although not shown, slot 290 can protrude lower than lip 228.

Figure 17:
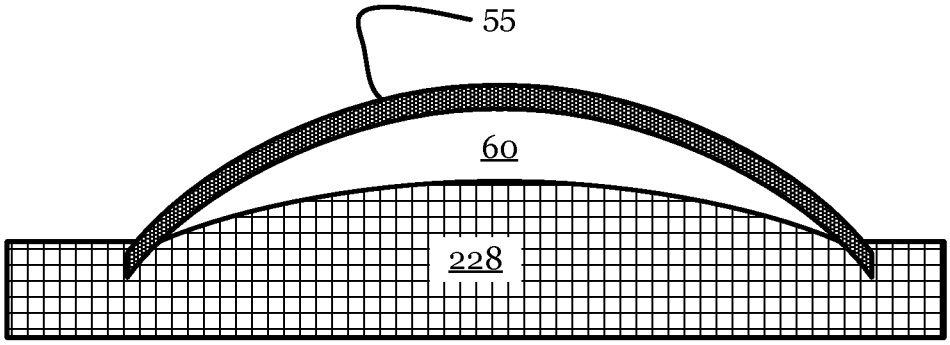
FIG. 17 is a rear elevational view of the user deforming a flexible and compressible well lip.

Lip 228 can be made from a soft and flexible polymer (e.g., thermoplastic polyurethane) while any and all of the remaining features of well 220 can be made from a rigid polymer (e.g., polypropylene). As such, lip 228 can be downwardly compressible. Referring to FIG. 17, and due to the downward force exerted by fingernail 55 onto lip 228, outer edges of fingernail 55 can inwardly compress lip 228. In response, the portion of lip 228 between the fingernail edges can upwardly deform (e.g., flex or bow) to offer additional pivot support for fingernail 55.

Links 300, as shown in FIGS. 1 and 2, can be thin and flexible. Each link 300 can connect one lid 400 to base 200. Each link 300 can operate as a spring. When lid 400 is disengaged from well 220 (and thus well 220 is open), link 300 can bias lid 400 to a resting position.

Figure 18:
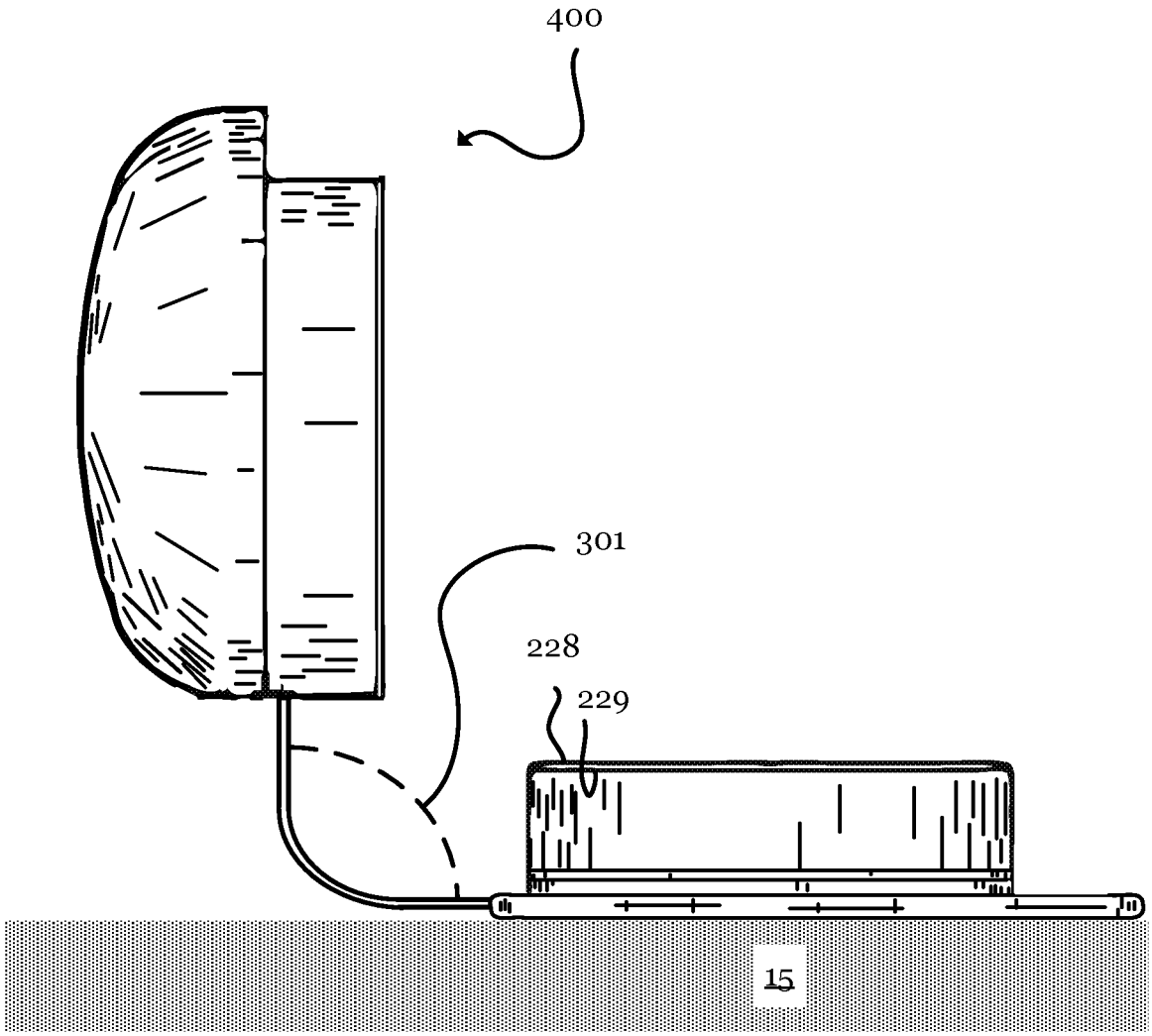
FIG. 18 is a left elevational view of the contact lens case where lids of the case are in an open resting position.

As shown in FIG. 18, the resting position can form an angle 301 with respect to the ground-plane. The angle can be less than 150, 140, 130, 120, 110, 100, 90, 80, 75, 70, 65, 60, 55, 50, 45, 40, 35, 30, 25, 20, and/or 15 degrees. Link 300 can be configured such that in the resting position: (a) no portion of lid 400 touches the ambient counter 15; (b) no reference plane defined by foundation upper surface 211, if extended to infinity, intersects lid 400. The resting position can be a resting band of 55-125 degrees.

Link 300 can be configured such that in the resting position, no portion of link 300 touches the ambient counter. Link 300 can be configured to exert a biasing spring force even when lid 400 is static and in snug engagement with well 220. As a result, after the user releases lid 400 from snug engagement, link 300 can cause lid 400 to pop open toward the resting position. Alternatively, link 300 can be configured such that the weight of lid 400 exceeds the counter-biasing spring force of link 300 and thus lid 400 rests directly on the ambient counter.

In at least FIGS. 1, 2, 5, 6, 7, and 8, case 100 is shown as stretched open, meaning that if link 300 is configured to exert spring force, link 300 has been stretched to its maximum length. In at least FIGS. 3 and 4, case 100 is fully closed. If link 300 is configured to exert spring force, link 300 can be exerting an opening force biasing lid 400 away from well 220.

Lid 400 can include a head 410 and a retaining ring 420 (also called a collar or a retainer). Both head 410 and ring 420 can be hollow. Head 410 can be completely hollow throughout or partially hollow. When partially hollow, head dome 411 can be hollow and hat 412 can be dense.

Head 410 can thus include a dome 411 and a hat 412. The interface between dome 411 and ring 420 can be continuous except for a minor radially protruding edge (i.e., substantially continuous). Hat 412 can protrude from dome 411 to define a step 413. As shown in FIG. 1, step 413 can be flat. In other embodiments, step 413 is arced. A user can disengage lid 400 from well 220 by applying an upward force against step 413. As discussed above, after lid 400 has partially disengaged from well 220, the upward biasing force of link 300 can cause lid 400 to entirely disengage from well 220 and occupy the resting position. As shown in FIG. 2, step 413 can have a U-shaped surface area.

Referring to FIG. 2, head 410 and/or ring 420 can define inner surfaces 430 of cap 400. Inner surface 430 can include a cliff 431, a ceiling 432, and a circular artifact 433, which can have the same diameter as well artifact 223*d*. Cliff 431 can be steep and be defined by both head 410 and ring 420. Cliff 431 can form a maximum angle with respect to vertical of less than 15, 12, 10, 8, or 5 degrees. Cliff 431 can form a plurality of angles with respect to the vertical, and in some cases, an angle that continuously varies in the vertical dimension, but is uniform in the ground-plane dimension. Cliff 431 can be sloped to frictionally engage lip 228 and/or outer sealing surface 221 of well 220 at least during the second and third closing stages (discussed below).

The transition between cliff 431 and ceiling 432 can be continuous. Ceiling 432 can be arced. Head 410, but not ring 420, can define ceiling 432. An artifact 433 can exist inside ceiling 432. Ceiling 432 can be smooth and continuous, except for artifact 433. Lid artifact 433 can be vertically aligned with base artifact 233*d* (e.g., their respective centers can be vertically collinear). Artifacts 433, 233*d* can have the same configurations. Lid 400 can include a lip 440 with the same configuration as well lip 228.

Lid 400 can be configured such that the closing process of case 100 happens in stages. In a first stage, lid 400 can slip over well 220. During the first stage, any frictional contact between lid 400 and well 220 can be insufficient to resist the counter-biasing opening force of link 300. During the second stage, frictional contact between lid 400 and well 220 can exceed the counter-biasing opening force of link 300 such that if the user stopped applying force against lid 400, lid 400 would remain static (i.e., motionless). The second stage can occur before any portion of lid 400 contacts and/or becomes coplanar (in a plane coplanar with the ground-plane) with collar 222. During the second stage, the user can press lid 400 past collar 222.

A third and final stage can represent a fully closed position where lid 400 can no longer move downward and is stopped against foundation 210. At the third stage, collar 222 can outwardly bear against lid 400 (e.g., against lid cliff 431.). As a result, lid ring 420 can outwardly deform. To discourage reciprocal inward deformation due to lid ring 420, collar 222 can be coplanar (i.e., coplanar in a plane parallel with the ground-plane) with transition 223*b* and/or floor 223*c*, since the radial thickness of well 220 can be greater in those regions.

Figure 19:
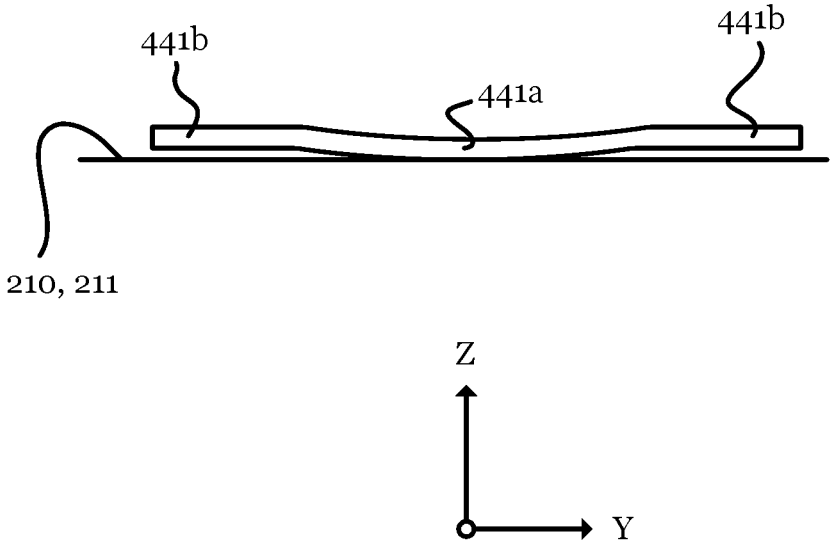
FIG. 19 is a schematic, cross sectional, side elevational view of the contact lens case in a fully closed position. Hatched and stippled features are in cross-section.

At the third stage, every point at peripherally extending apex 441 of lid lip 440 can be disposed below collar 222. However, due to the outward deformation of collar 222, only some points on apex 441 can be in direct contact with foundation 210. As schematically shown in FIG. 19, intermediate portions 441*a* of apex 441 (only one is shown, but another intermediate portion 441 can exist on the opposite side of lid 400) are in direct contact with foundation 210 while front and rear portions 441*b* of apex 441 are disposed slightly above foundation 210. In FIG. 19, intermediate portions 441*a* of apex are either undeformed or deformed to a lesser degree while front and rear portions of apex 441 are deformed to a greater degree. According to some embodiments, apex 441 would sit flush against foundation top surface 211 if collars 212 were removed.

Figure 20:
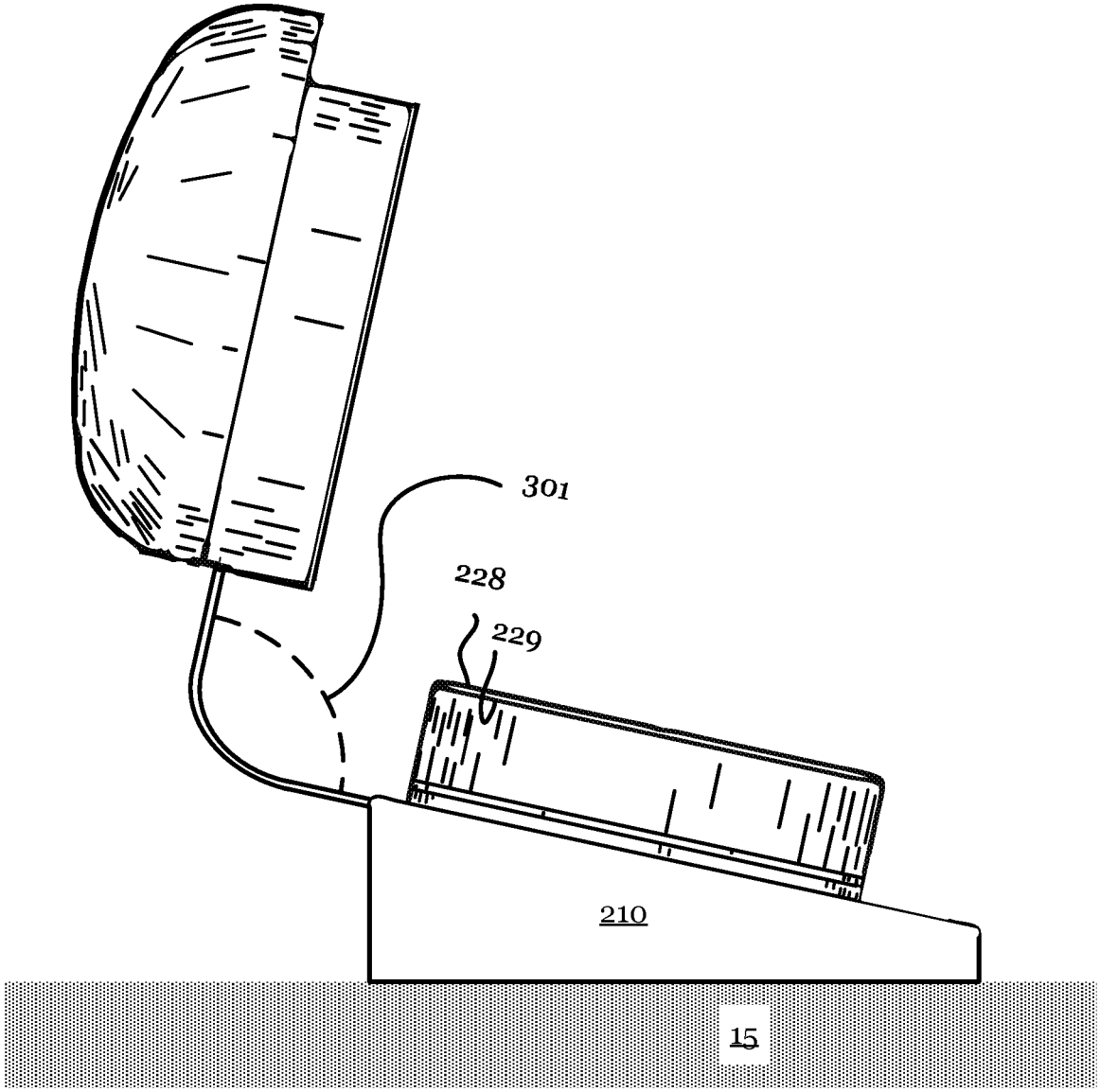
FIG. 20 is a side elevational view of the contact lens case with a ramped foundation.
Figure 21:
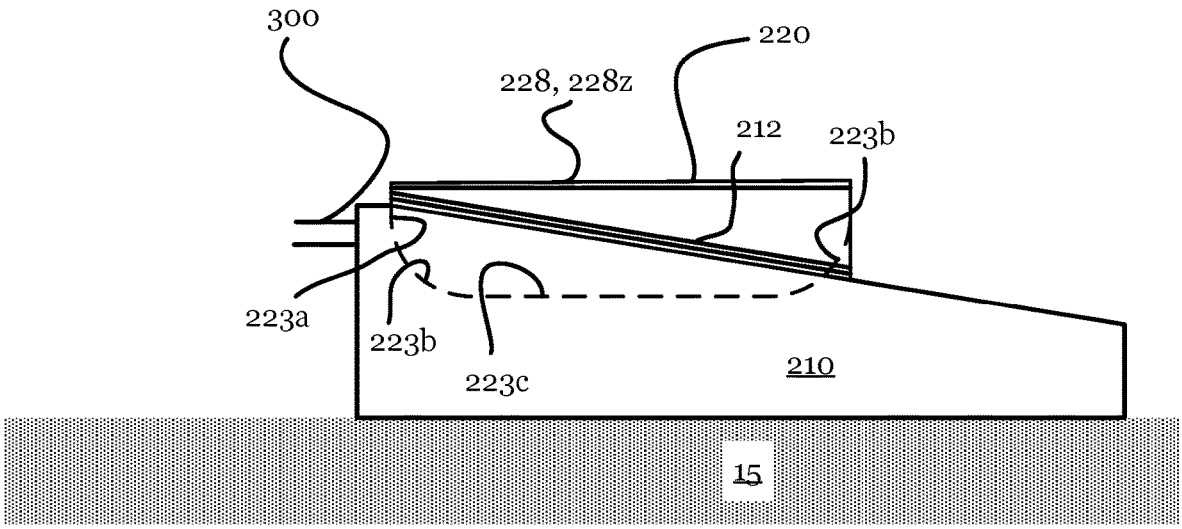
FIG. 21 is a side elevational view of the contact lens case with a ramped foundation. Features shown in broken lines are hidden.

As previously discussed, foundation 210 can have a constant thickness. In other embodiments, and as shown in FIG. 20, foundation 210 can be ramped at an incline of greater than or equal to 3, 5, 7, 10, 15, 20, 25, 30 degrees to form a wedge. Wells 220 can retain the above-discussed vertical orientation with respect to the counter. As shown in FIGS. 20 and 21, some or all of well lip 228 can lie vertically above the highest point on foundation 210 to reduce the possibility of foundation 210 interfering with fingernail pivot.

Figure 22:
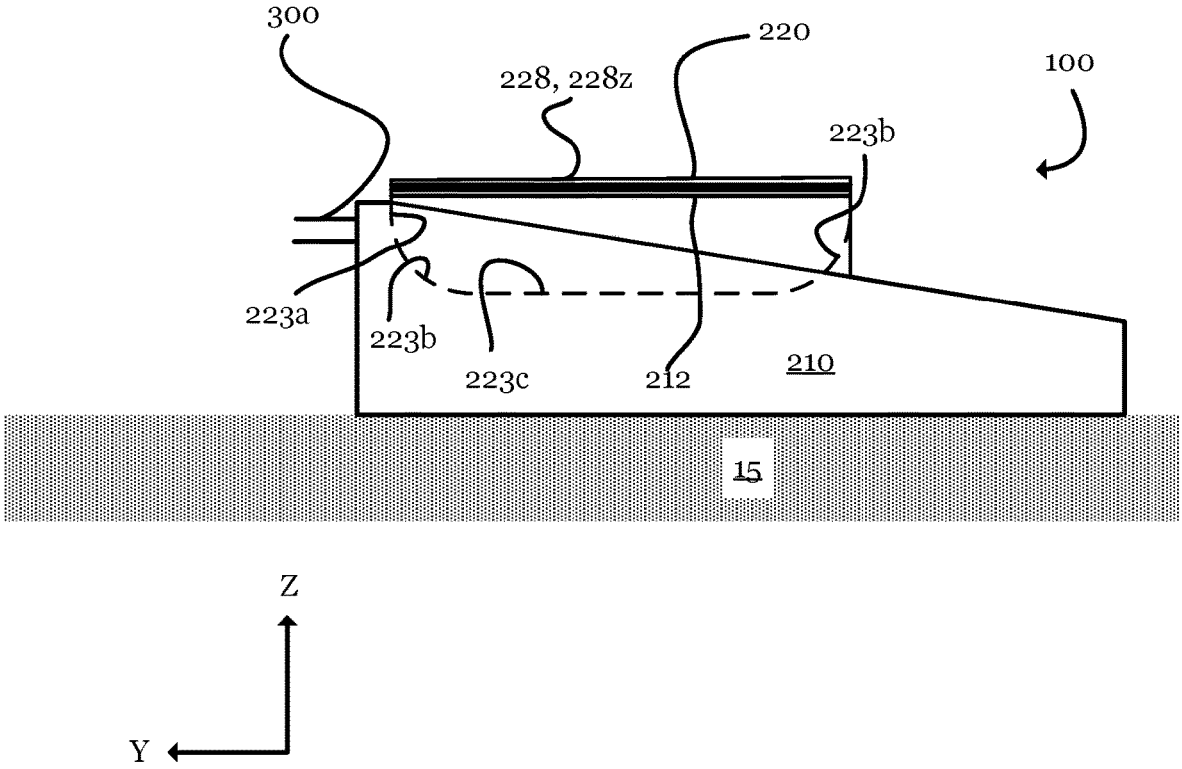
FIG. 22 is a side elevational view of the contact lens case with a ramped foundation. Features shown in broken lines are hidden.
Figure 23:
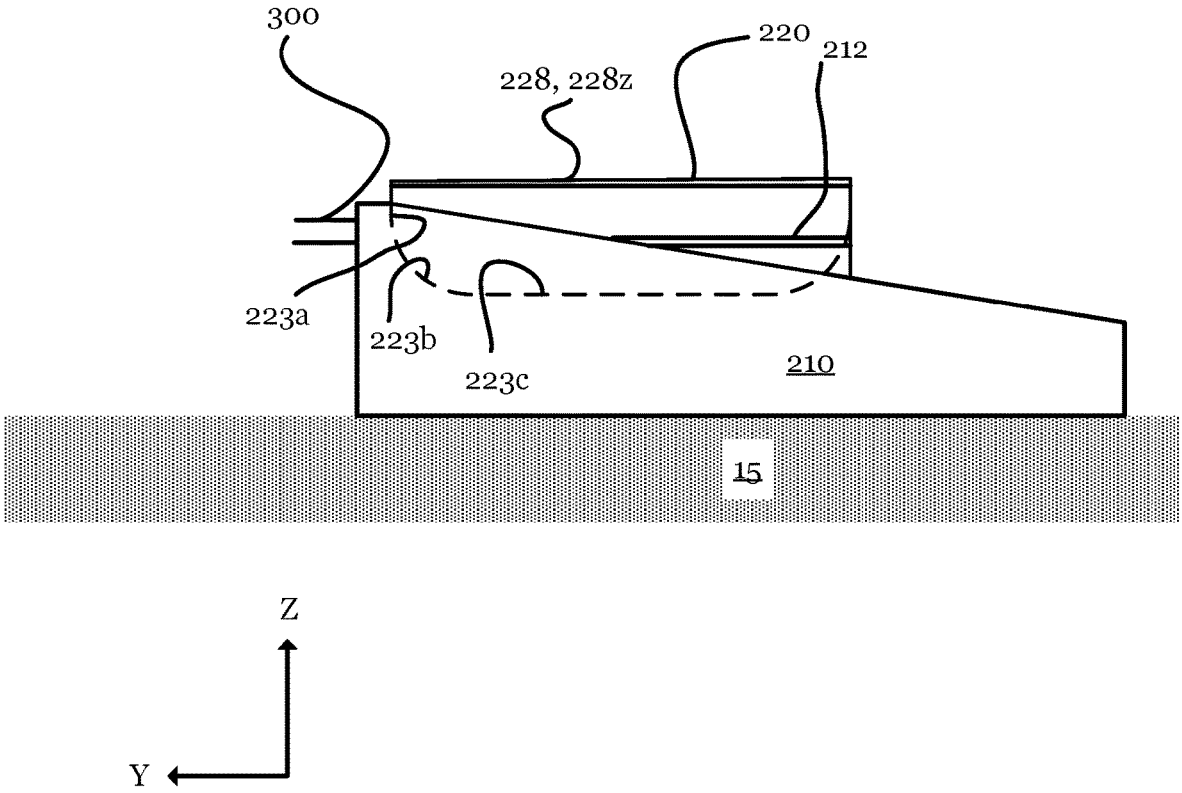
FIG. 23 is a side elevational view of the contact lens case with a ramped foundation. Features shown in broken lines are hidden.

FIG. 21 is another embodiment of case 100 with a ramped foundation 210. FIG. 21 shows hidden features with broken lines. Well 220 can at least partially protrude into foundation 210. Well 220 can be configured such that a plane defined by the apex 228*z* of lip 228 is parallel with counter 15. Collar 212 can follow the incline of upper foundation surface 211. Lid 400 is unshown and link 300 is only partially shown. Lid 400 can be configured to match the exposed geometry of well 220. Lid 400 can have any of the previously discussed features and configurations. According to another embodiment (FIG. 22), collar 212 can extend parallel to lip 228. According to a further embodiment (FIG. 23), collar 212 can only extend about a front portion of case 100.

Foundation 210 can be dimensioned such that the center of gravity of case 100, when in the stretched open position of FIG. 1, is disposed directly vertically above a point on base 200. Foundation 210 can be dimensioned such that the center of gravity of case 100 is disposed directly vertically above a point on base 200 when case 100 is opened and link 300 have biased lids 400 to the above-described resting position. At the same time, foundation 210 can be dimensioned such that the center of gravity of case 100 is not disposed directly vertically above base 200 when case 100 is in the stretched opened position. As with all features disclosed herein, links 300 are illustrative. In some embodiments, links 300 are absent and lids 410 can be completely disconnected from base 200.

Figure 25:
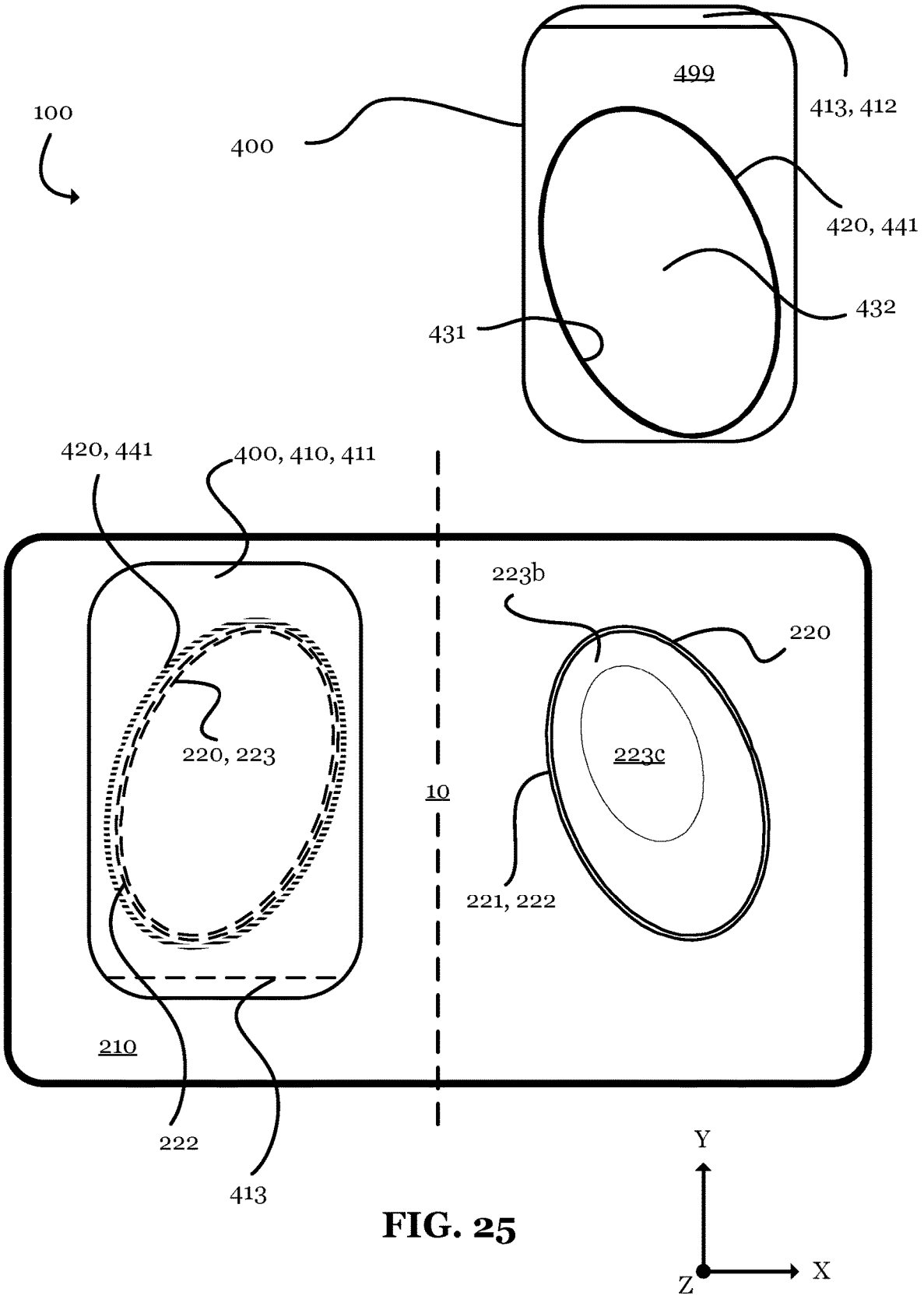
FIG. 25 shows the case with longitudinally angled wells. Hidden features of the left side of the contact lens case are shown in broken lines.

As shown in FIG. 25, one or both wells 220 can have a major axis slanted with respect to the longitudinal. Lid rings 420 can be rearranged to match wells 220. Case 100 of FIG. 25 can otherwise have the same features as any of the cases 100 described above, including the case 100 shown in FIG. 1. Case 100 can omit links 300, as shown.

Left lid 400 is closed while right lid 400 is open. FIG. 25 therefore shows a bottom plan view of right lid 400. Hidden features are shown with broken lines with respect to the left lid/well assembly 400, 220. Floor 223*c* can be offset from a vertical axis of well 220, as shown. Floor 223*c* can be aligned with the central axis of well 220 (not shown). Ring 420 can include surface 499 such that the bottom of lid 400 has the same depth (i.e., is X-Y coplanar), except for the blind hole defined by lip 441 and step 413, if present. Alternatively, ring 420 can vertically protrude from surface 499, as shown in FIG. 1. The offset between lid lip 441 and collar 222 is only for clarity. In use, collar 222 can be in direct contact with interior surface 431 of lid lip. The features discussed with reference to FIG. 25 can be applied to any embodiment. Any features previously discussed can be applied to FIG. 25. For example, foundation 210 can be ramped, floor 223*c* can be offset along the minor axis of well 220, etc.

Case 100 can be entirely made from injection molding a rigid polymer, a flexible polymer, etc. Case 100 can be made from other manufacturing processes (e.g., one or more portions of case 100 can be machined from metal. Wells 220 can have a first color (e.g., a translucent white) and the remainder of case 100 can have a second color (e.g., blue, pink). Wells 220 and rings 420 can have a first color (e.g., translucent white) and the remainder of case 100 can have a second color (e.g., blue, pink).

According to some of many embodiments, case 100 can have the following dimensions: the maximum major axis (i.e., from the front-most portion of outer sealing surface 221 to the rear-most portion of outer sealing surface 221) can be 30-43, 33-41, 34-39, 35-37 mm; the maximum minor axis (i.e., from the left-most portion of outer sealing surface 221 to the right-most portion of outer sealing surface 221) can be 18-27 mm, 20-25 mm, 22-24 mm. Well 220 can have a maximum depth (measured from lip 228) of at least 0.3, 0.4, 0.45, 0.5, or 0.55 cm. Well 220 can have a depth of 0.3-0.8, 0.4-0.7, 0.5-0.6, and/or 0.6±10% cm. Any of the features discussed herein can be combined into a single embodiment. Case 100, although useful for storing contact lenses, can be used for other purposes (e.g., storing pills).

I claim:

1. A contact lens case comprising:

(a) a base comprising a foundation and a pair of wells, each of the wells comprising:

a domed lip, each lip forming an oval-shaped ring when viewed from a top plan perspective, each well defining a lens-solution pool having a maximum depth of at least 4 mm and comprising a base artifact; and a steep outer surface from which a collar radially projects towards the domed lip, the collar partitioning the outer surface into an upper portion and a lower portion, the upper portion existing above the collar, the lower portion existing below the collar;

(b) a pair of lids for sealing the pair of wells, each of the lids comprising a head and a ring, each head comprising a dome and a domed hat projecting and protruding from the dome, the hat defining a step with a U-shaped surface area, and the head defining an inner surface of the lid, the inner surface comprising a lid artifact vertically aligned with the base artifact when the lid is in a fully closed position; and (c) a pair of links, each of the links physically connecting one of the lids to the base, each of the links being biased to lift the lids away from the wells;

each collar being configured to exert an outward radial force against each ring when the lids are in a fully closed position.

2. The case of claim 1, wherein each of the lens-solution pools is carrying contact lens solution and a contact lens.

3. The case of claim 1, wherein the collars are configured to deform the rings when the lids are in the fully closed position.

4. The case of claim 3, wherein the collars are configured to non-uniformly deform perimeters of the rings when the lids are in the fully closed position, the perimeters being defined in a plane parallel to a top surface of the foundation.

5. The case of claim 4, configured such that when the lids are in the fully closed positions, each of the lids fully covers a respective one of the collars such that neither of the collars are externally visible.

6. The case of claim 5, wherein each collar has a uniform radial thickness, the collars being disposed closer to the top surface of the foundation than the lips of the wells.

7. The case of claim 1, configured such that when the lids are in a fully closed position, only a portion of each lid is in direct contact with the foundation.

8. The case of claim 1, wherein each lip is made from a soft and flexible polymer.

9. The case of claim 1, wherein a transition between the dome and the hat is smooth and continuous.

10. The case of claim 1, wherein each well comprises a floor, each floor defining a respective one of the maximum depths, each floor having a center that is longitudinally and/or horizontally offset from a center of a respective one of the wells.

11. A method of using the case of claim 1 comprising sealing the pair of wells with the pair of lids.

12. A method of using the case of claim 1 comprising fully closing the lids.

13. A contact lens case comprising:

a lid comprising a head and a ring, the head comprising a dome and a domed hat projecting and protruding from the dome, the hat defining a step with a U-shaped surface area, and the head defining an inner surface of the lid, the inner surface comprising a lid artifact;

a base comprising a foundation and a well comprising:

a domed lip, forming an oval-shaped ring when viewed from a top plan perspective, the well defining a lens-solution pool having a maximum depth of at least 4 mm and comprising a base artifact vertically aligned with the lid artifact when the lid is in a fully closed position; and a steep outer surface from which a collar radially projects towards the domed lip, the collar partitioning the outer surface into an upper portion and a lower portion, the upper portion existing above the collar, the lower portion existing below the collar;

the collar being configured to exert an outward radial force against a lid ring when the lid is in a fully closed position.

14. The case of claim 13, wherein the lens-solution pool is carrying contact lens solution and a contact lens.

15. The case of claim 13, wherein the collar is configured to non-uniformly deform the lid when the lid is in the fully closed position.

16. The case of claim 15, configured such that when the lid is in the fully closed position, only a portion of the lid is in direct contact with the foundation.

17. The case of claim 16, wherein the well comprises a floor defining the maximum depth, the floor having a center that is longitudinally and/or horizontally offset from a vertically extending central axis of the well.

18. The case of claim 13, wherein the lip is domed in a radial direction.

19. A method of using the case of claim 13 comprising fully closing the lid.

20. A contact lens case comprising:

(a) a base comprising a foundation and a pair of wells, each of the wells comprising:

a domed lip, each lip forming an oval-shaped ring when viewed from a top plan perspective, each well defining a lens-solution pool having a maximum depth of at least 4 mm and comprising a base artifact; and a steep outer surface from which a collar radially projects, the collar partitioning the outer surface into an upper portion and a lower portion, the upper portion existing above the collar, the lower portion existing below the collar;

(b) a pair of lids for sealing the pair of wells, each of the lids comprising a head and a ring, each head comprising a dome and a domed hat projecting and protruding from the dome, the hat defining a step with a U-shaped surface area and the head defining an inner surface of the lid, the inner surface comprising a lid artifact vertically aligned with the base artifact when the lid is in a fully closed position; and (c) a pair of links, each of the links physically connecting one of the lids to the base, each of the links being biased to lift the lids away from the wells;

each collar being configured to exert an outward radial force against each ring when the lids are in a fully closed position;

wherein at least one well has a major axis that is angled with respect to a longitudinal axis of the base; and wherein at least one lip defines a slot, the slot forming a downward arc when viewed from an elevational perspective.

* * * * *